US006070029A

United States Patent [19]

Nishiuwatoko et al.

[11] Patent Number: 6,070,029

[45] Date of Patent: May 30, 2000

[54] COUPLING MEMBER, PROCESS CARTRIDGE, ELECTROPHOTOGRAPHIC IMAGE FORMING APPARATUS AND ASSEMBLING METHOD

[75] Inventors: Tsutomu Nishiuwatoko, Tokyo; Kouji Miura, Mishima; Kazuhiko Kanno, Numazu, all of Japan

[73] Assignee: Canon Kabushiki Kaisha, Tokyo, Japan

[21] Appl. No.: 08/689,124

[22] Filed: Jul. 30, 1996

[30] Foreign Application Priority Data

Jul. 31, 1995 [JP] Japan ..... 7-194522
Jul. 31, 1995 [JP] Japan ..... 7-194988

[51] Int. Cl.[7] ..... G03G 21/18

[52] U.S. Cl. ..... 399/111; 399/113

[58] Field of Search ..... 399/110, 111, 399/113, 119

[56] References Cited

U.S. PATENT DOCUMENTS 5,153,649 10/1992 Park .
5,331,373 7/1994 Nomura et al. ..... 355/200
5,450,166 9/1995 Yashiro .
5,452,056 9/1995 Nomura et al. ..... 355/200
5,500,714 3/1996 Yashiro et al. ..... 355/200
5,585,889 12/1996 Shishido et al. ..... 355/200

FOREIGN PATENT DOCUMENTS 0405514 1/1991 European Pat. Off. .
0586044 3/1994 European Pat. Off. .

*Primary Examiner*—Joan Pendergrass
*Attorney, Agent, or Firm*—Fitzpatrick, Cella, Harper & Scinto

[57] ABSTRACT

A coupling member for coupling a first frame and a second frame of a process cartridge detachably mountable to a main assembly of an image forming apparatus, the process cartridge including the first frame having an electrophotographic photosensitive member and a photosensitive member mounting portion for mounting the electrophotographic photosensitive member, the second frame having a developing means for developing a latent image formed on the electrophotographic photosensitive member and a developing means mounting portion for mounting the developing means, the coupling member includes a connecting portion for rotatably coupling the first frame and second frame; a spring mounting portion for mounting a spring for applying elastic force to the first frame and second frame; and a coupling member locking portion for locking the coupling member to the second frame.

29 Claims, 20 Drawing Sheets

COUPLING MEMBER, PROCESS CARTRIDGE, ELECTROPHOTOGRAPHIC IMAGE FORMING APPARATUS AND ASSEMBLING METHOD

FIELD OF THE INVENTION AND RELATED ART

The present invention relates to a process cartridge, a shutter usable with the process cartridge and an image forming apparatus usable with the process cartridge.

Here, the image forming apparatus includes an electrophotographic copying machine, an electrophotographic printer (for example, LED printer, laser beam printer), an electrophotographic facsimile machine, an electrophotographic word processor, and the like.

The process cartridge means a cartridge having as a unit an electrophotographic photosensitive member, and charging means, developing means and cleaning means, which are detachably mountable to a main assembly of an image forming apparatus. It may include as a unit an electrophotographic photosensitive member and at least one of charging means, developing means and cleaning means. It may include as a unit developing means and an electrophotographic photosensitive member.

An image forming apparatus using an electrophotographic process is known which is used with the process cartridge. This is advantageous in that the maintenance operation can be, in effect, carried out by the users thereof without expert service persons, and therefore, the operativity can be remarkably improved. Therefore, this type is now widely used.

In such a process cartridge, it is desirable that the gap between a developing roller and said electrophotographic photosensitive member is maintained uniform in order to provide good image quality. Therefore, the first frame supporting the electrophotographic photosensitive member and the second frame supporting the developing means are made rotatable relative to each other, and the electrophotographic photosensitive member and the developing roller are urged to each other with spacer rollers therebetween adjacent to the opposite ends of the developing roller.

The present invention relates to a further development of such a process cartridge.

SUMMARY OF THE INVENTION

Accordingly, it is a principal object of the present invention to provide a coupling member, process cartridge, electrophotographic image forming apparatus and assembling method, wherein frames can be easily coupled.

It is another object of the present invention to provide a coupling member, process cartridge, electrophotographic image forming apparatus and assembling method, wherein an electrophotographic photosensitive member and developing means can be easily positioned relative to each other.

It is a further object of the present invention to provide a coupling member for coupling a first frame and a second frame of a process cartridge detachably mountable to a main assembly of an image forming apparatus, the process cartridge including the first frame having an electrophotographic photosensitive member and a photosensitive member mounting portion for mounting the electrophotographic photosensitive member, the second frame having a developing means for developing a latent image formed on the electrophotographic photosensitive member and a developing means mounting portion for mounting the developing means, the coupling member comprising: a connecting portion for rotatably coupling the first frame and second frame; a spring mounting portion for mounting a spring for applying elastic force to the first frame and second frame; and a coupling member locking portion for locking the coupling member to the second frame.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferable embodiments of the present invention will be described.

Embodiment

Embodiment 1

Referring to FIGS. 1–16, the first embodiment of the present invention will be described. The description will be given in the order of the general structures of an electrophotographic image forming apparatus and a process cartridge, a structure for installing or removing the process cartridge, a structure for detecting the presence or absence of the process cartridge, a structure for connecting a cleaning frame and a development frame, and a structure for establishing electrical connection.

[General Structure of Process Cartridge and Electrophotographic Image Forming Apparatus]

Figure 1:
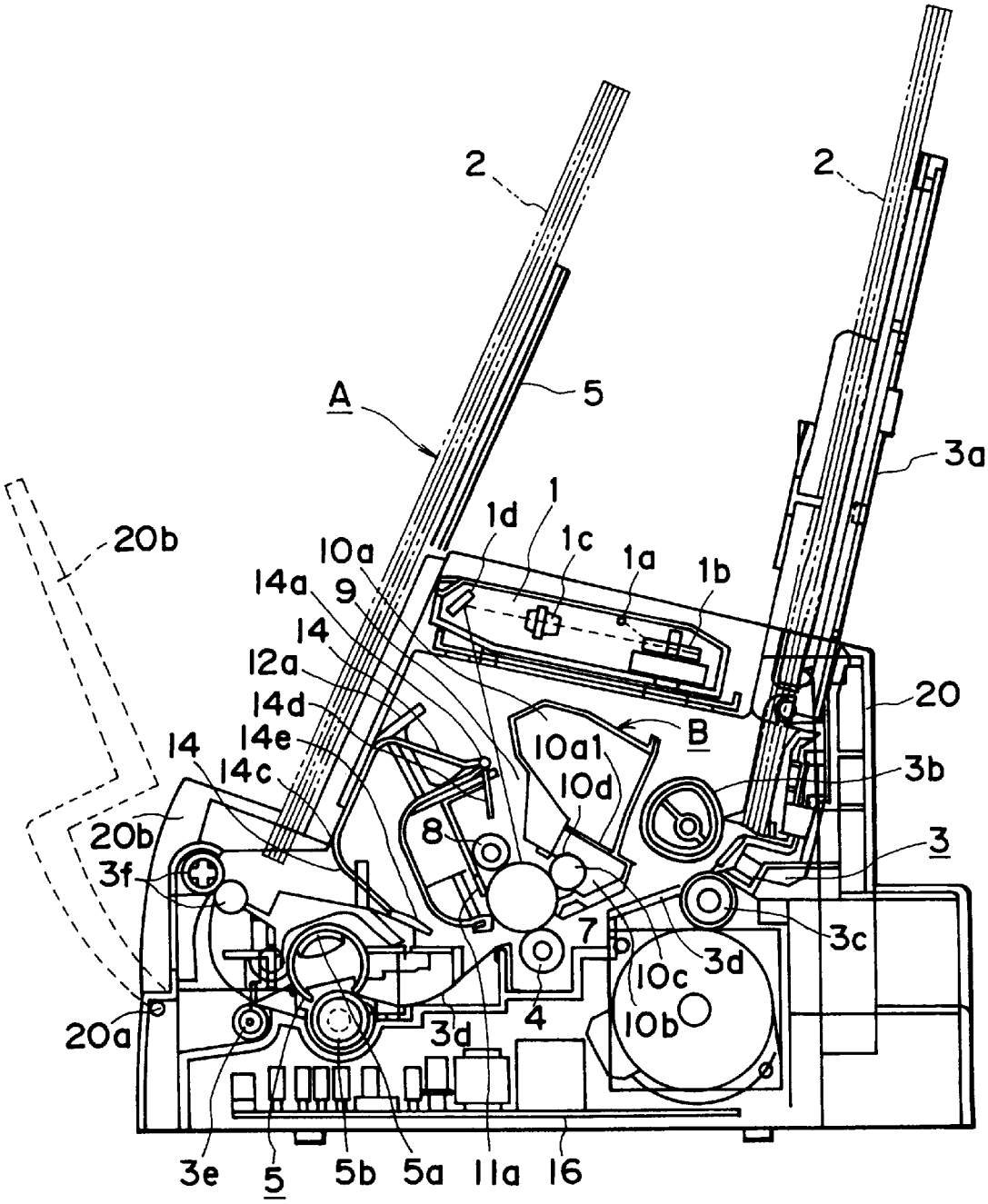
FIG. 1 is a schematic sectional drawing of the general structure of an image forming apparatus including the process cartridge, in an embodiment of the present invention.
Figure 2:
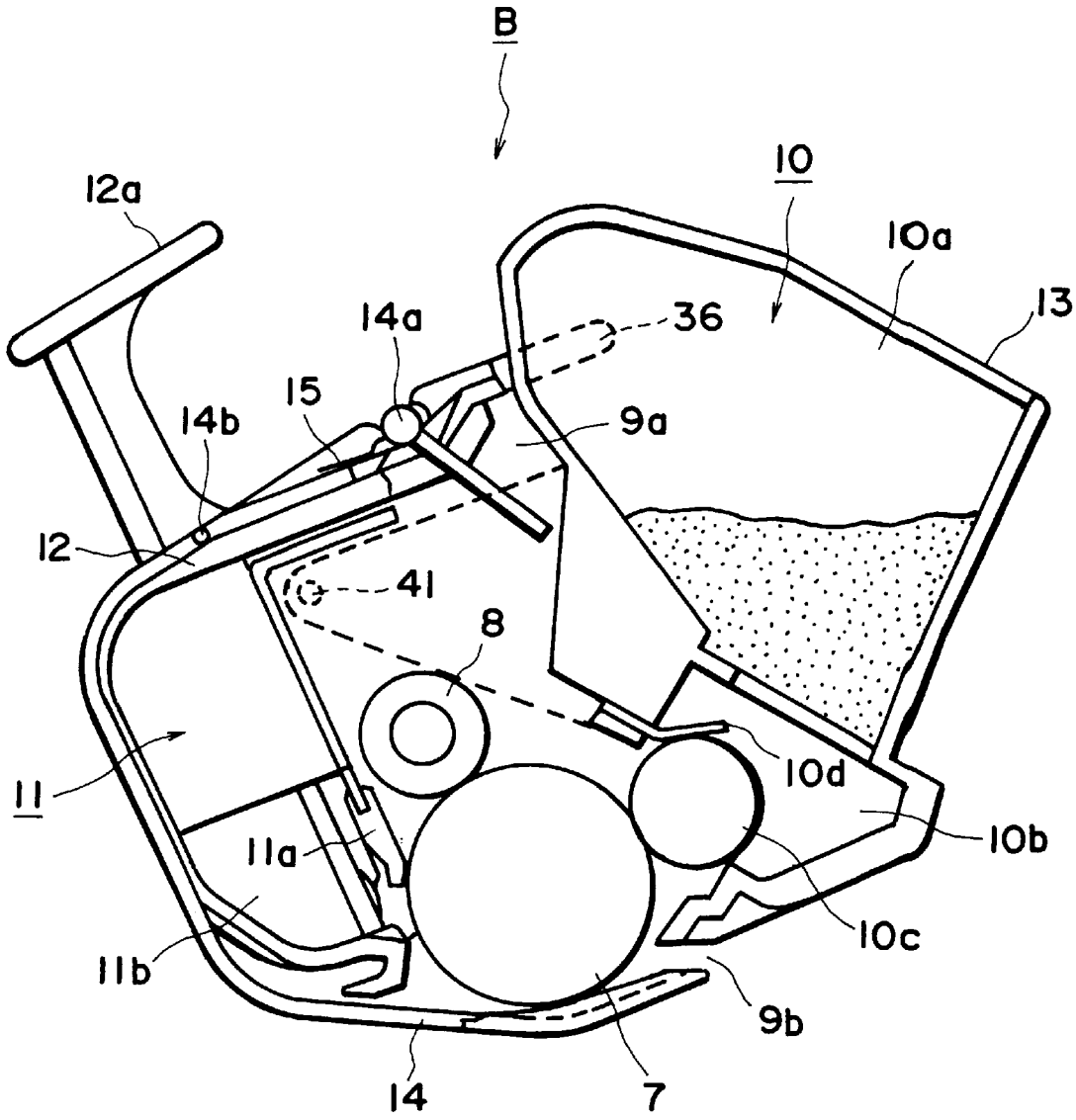
FIG. 2 is a schematic sectional drawing of the process cartridge.
Figure 3:
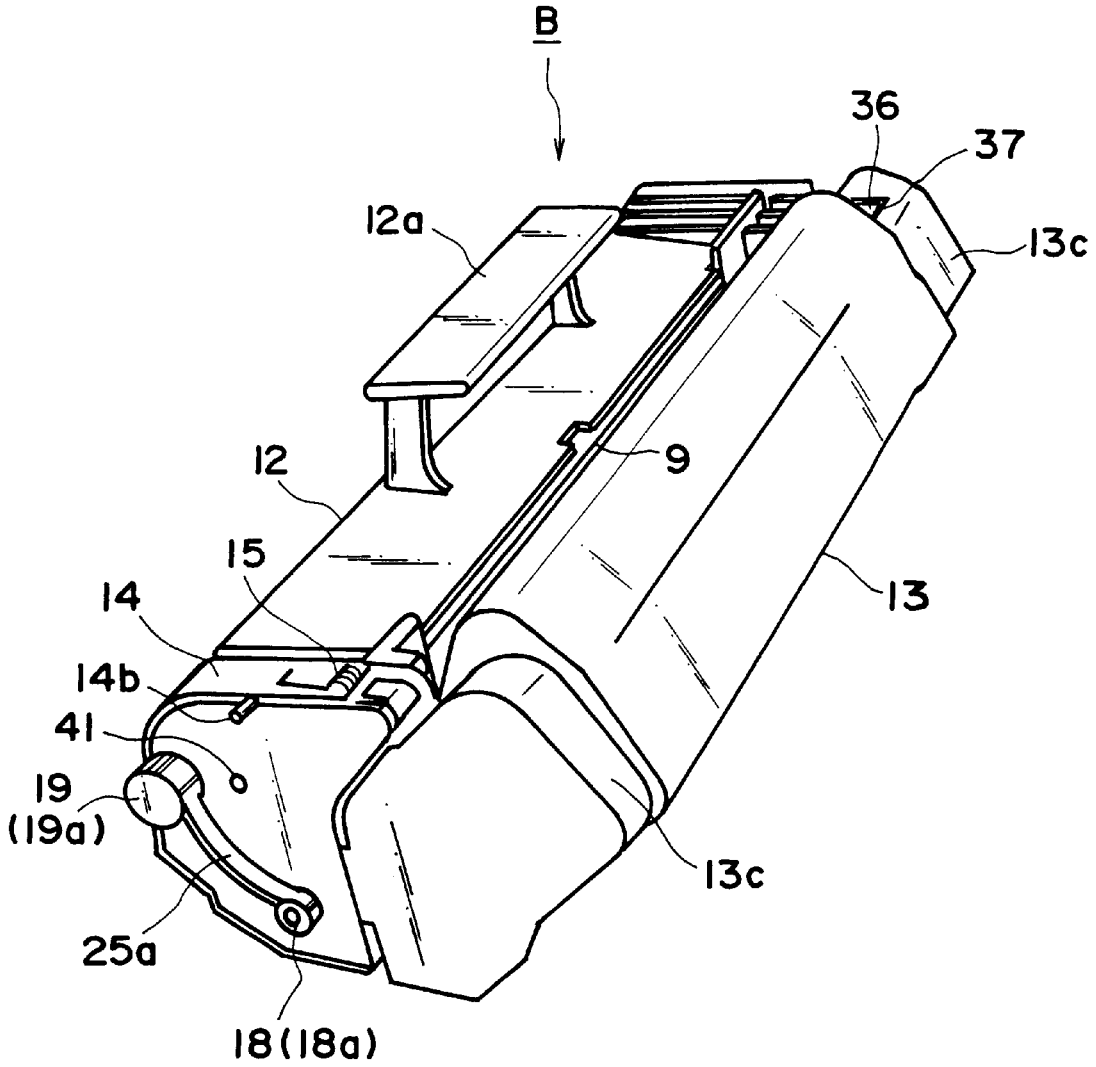
FIG. 3 is a perspective external view of the process cartridge.

Referring to FIGS. 1–3, the general structures of an electrophotographic image forming apparatus and a process cartridge will be described. FIG. 1 is a schematic sectional drawing of the general structure of the image forming apparatus comprising the process cartridge 1. FIG. 2 is a schematic sectional drawing of the structure of the process cartridge 1. FIG. 3 is an external perspective view of the process cartridge.

This electrophotographic image forming apparatus A (laser beam printer in this embodiment) forms images through an electrophotographic process. More specifically, referring to FIG. 1, an electrophotographic photosensitive member in the form of a drum (hereinafter, photosensitive drum) of a process cartridge B is charged with a charging means, and a laser beam modulated with image data is projected from an optical means onto the charged photosensitive member to form a latent image. Then, the latent image is developed into a toner image by a developing means.

Next, in synchronism with the toner image formation, a recording medium 2 in fed out from a feeder tray 3*a* by a pickup roller 3*b*, and is conveyed by a conveyer roller 3*c* or the like. Then, the toner image having been formed on the photosensitive drum is transferred onto the recording medium 2 by a transfer roller 4 as a transfer means.

Next, the recording medium onto which the toner image has been transferred from the photosensitive drum is conveyed to a fixing means 5, being guided by a guide plate 3*d*. This fixing means 5 comprises a fixing roller 5*a*, and a pressure roller 5*b* which presses the recording medium 2 onto the fixing roller 5*a* while advancing it. The fixing means 5 fixes the transferred toner image to the recording medium 2 by applying heat and pressure to the recording medium 2. The recording medium 2 to which the toner image has been fixed is conveyed and discharged into a copy catching portion 6 by roller pairs 3*e* and 3*f*. Incidentally, in this embodiment, the pickup roller 3*b*, the conveyer roller 3*c*, the guide plate 3*d*, and the discharge roller pairs 3*e* and 3*f* are employed as a means for conveying the recording medium 2.

On the other hand, the process cartridge B comprises an electrophotographic photosensitive member, and at least one processing means. As for the processing means, there are, for example, charging means for charging the electrophotographic photosensitive member, developing means for developing the latent image formed on the electrophotographic photosensitive member, cleaning means for cleaning the toner remaining on the surface of the electrophotographic photosensitive member, and the like. Referring to FIGS. 1 and 2, the process cartridge B in this embodiment integrally comprises a charging means, a developing means, and a cleaning means, in addition to the photosensitive drum 7.

The photosensitive drum 7 has a photosensitive surface layer. This photosensitive surface layer is uniformly charged by applying voltage to the charge roller 8 as the charging means while the photosensitive drum 7 is rotated. Then, a laser beam modulated with image data is projected from an optical means 1 onto the photosensitive drum 7 through an exposure opening 9*a* to form a latent image, and the latent image is developed with toner using a developing means 10. The optical system 1, which constitutes a laser unit, comprises a laser diode la which emits a laser beam in response to the image data, a polygon mirror 1*b* for deflecting the emitted laser beam so that the beam is projected onto the photosensitive drum 7 in a manner to scan the surface of the photosensitive drum 7, a lens 1*c*, a deflection mirror 1*d*, and a frame 1*e* which integrally houses the preceding components. The exposure opening 9*a* is provided between a cleaning frame 12, which will be described later, and a development frame 13.

Figure 16:
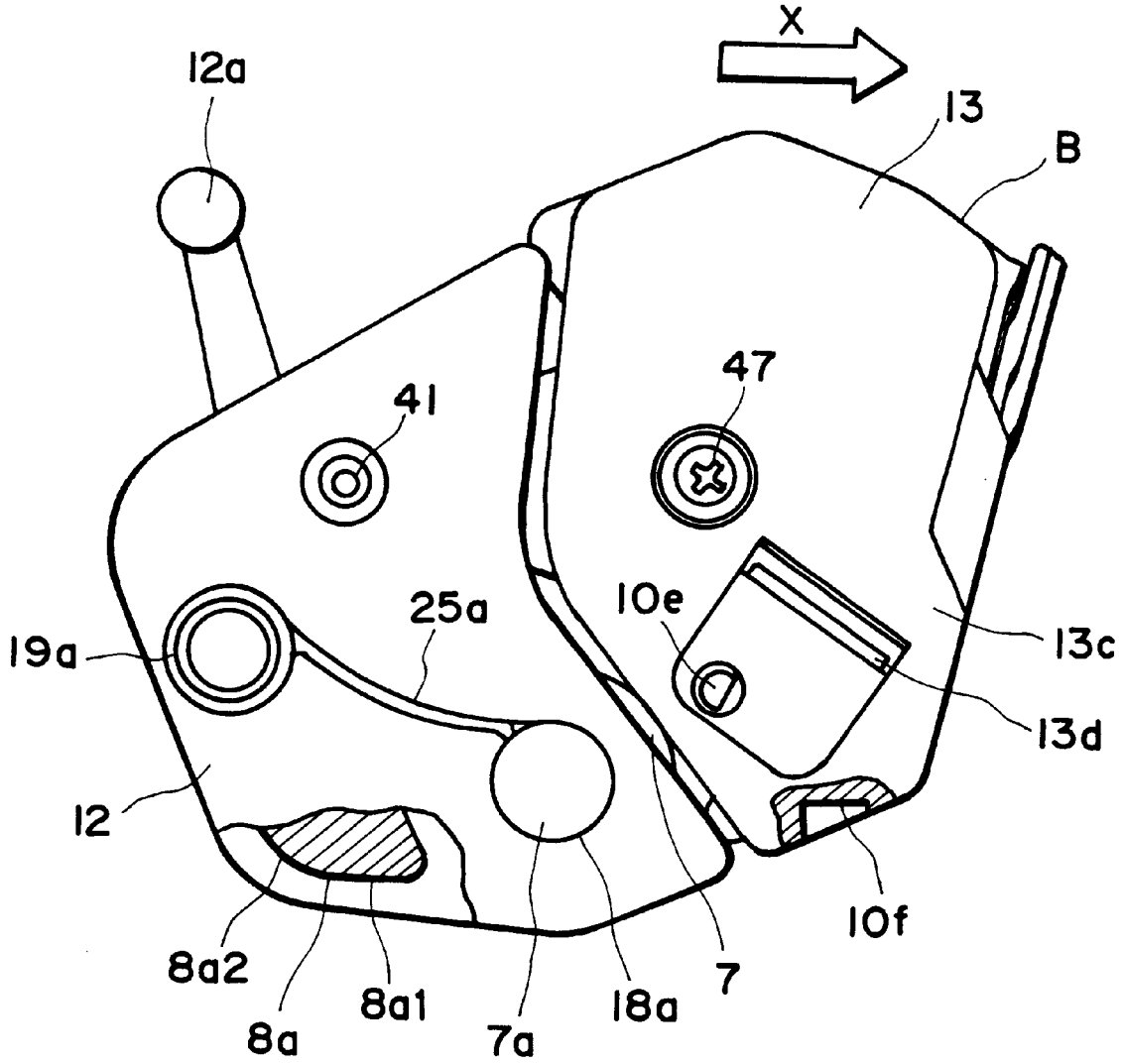
FIG. 16 is a side view of a process cartridge B (non-driven side).

The developing means 10 comprises a toner chamber 10*a*, a development chamber 10*b*, a development roller 10*c*, a development blade 10*d*, and a fixed magnet 10*e* (FIG. 16). The development roller 10*c* contains the fixed magnet 10*e*, and is disposed within the development chamber 10*b*. As the development roller 10*c* is rotated, the toner within the toner chamber 10*a* is fed into the development chamber 10*b*, and a layer of toner triboelectrically charged by the development blade 10*d* is formed on the surface of the development roller 10*c*. As the development roller 10*c* is further rotated, the toner thereon is supplied to the development region of the photosensitive drum 7 to develop the latent image into a toner image. Before a fresh process cartridge B is put to use, an operator needs to pull out a toner seal to unseal a toner supply opening 10*a*1 provided within the toner chamber 10*a*. As the operator shakes the process cartridge B, the toner within the toner chamber 10*a* is fed into the development chamber 10*b*. The development blade 10 regulates the thickness of the toner layer adhering to the peripheral surface of the development roller 10*c*. A reference numeral 13*d* designates an opening for pulling out the toner seal, and it is provided on a connecting member 13*c* (FIG. 16).

After the toner image is transferred onto the recording medium 2 by applying to the transfer roller 4 a voltage having polarity opposite to the toner image polarity, the toner remaining on the photosensitive drum 7 is scraped off by an elastic cleaning blade 11*a*. The scraped toner is collected into a waste toner dump 11*b*. A cleaning means 11 having the above structure is used to remove the residual toner on the photosensitive drum 7.

Figure 11:
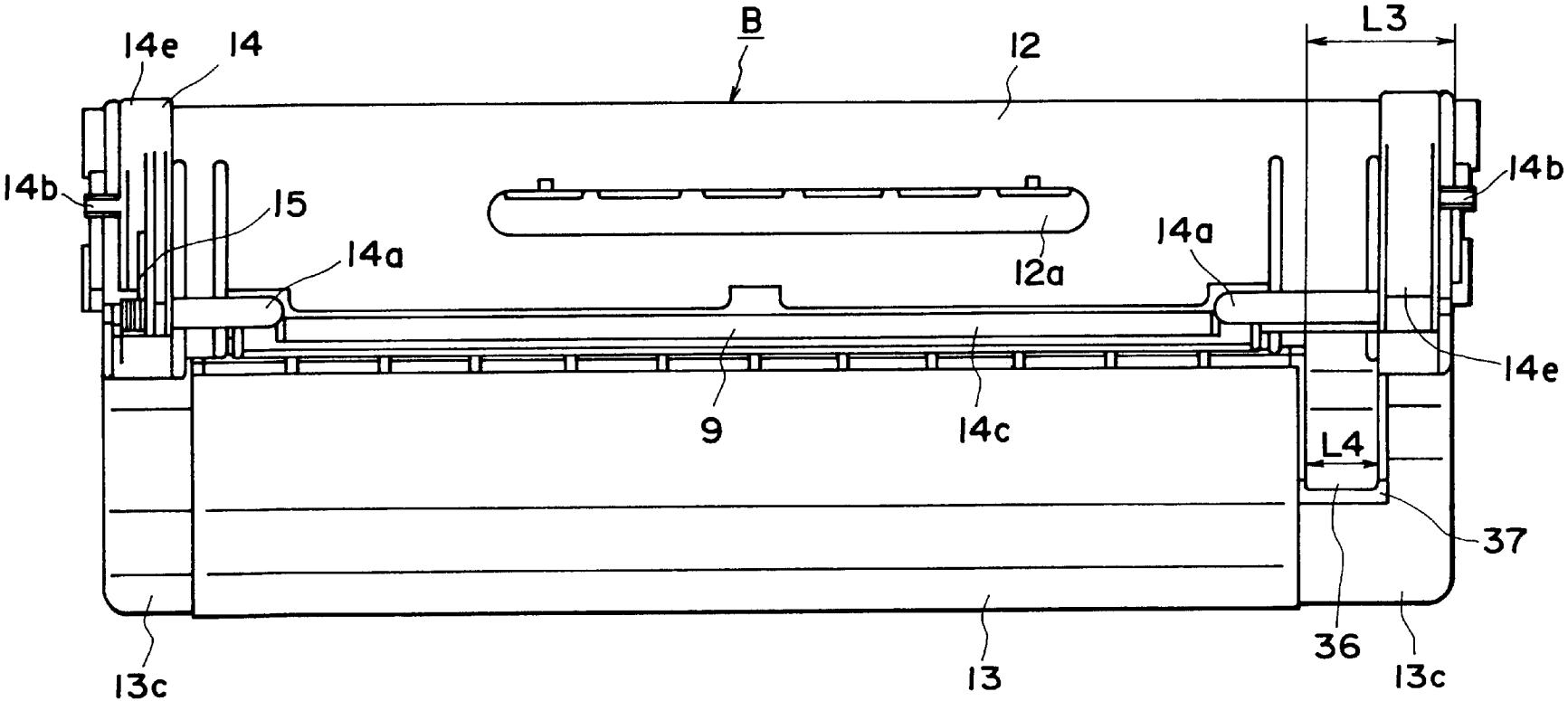
FIG. 11 is a schematic plan view of the detectable member provided on the cleaning frame.

The photosensitive drum 7 and the rest of the components are supported within the cartridge frame to be integrated as a cartridge. The cartridge frame has a cleaning frame 12 as a first frame for supporting the photosensitive drum 7, the charge roller 8, the cleaning means 11, and the like, and a development frame 13 as a second frame for supporting the developing means 10. The frames 12 and 13 are joined so as to be pivotable about an axis 41 relative to each other. Between the developing roller 10*c* and the photosensitive drum 7, a gap is provided, which is formed as the developing roller 10*c* and the photosensitive drum 7 are pressured toward each other with the presence of a spacer roller, which will be described later. The cartridge frame is provided with an exposure opening 9*a* for image exposure, and a transfer opening 9*b* for transferring the toner image formed on the photosensitive drum 7 onto a recording medium 2. The cartridge frame is also provided with a shutter member 14 for exposing or covering the exposure opening 9*a* and the transfer opening 9*b*. This shutter member 14 is attached to the cleaning frame 12 so that it is allowed to rotate about an axis 14*a*, being placed under the pressure constantly applied by a torsional coil spring 15 in the direction to keep the exposure opening 9*a* and the transfer opening 9*b* closed. As the operator inserts the process cartridge B into the apparatus main assembly 16, a shutter projection 14*b* provided at a predetermined point of the shutter member 14 becomes engaged with a predetermined point (unillustrated) of the apparatus main assembly 16. As a result, the shutter member 14 is rotated to expose the exposure opening 9*a* and the transfer opening 9*b* automatically. On the other hand, as the operator pulls out the process cartridge B from the apparatus main assembly 16, the shutter member 14 automatically closes due to the pressure from the spring 15. The shutter member 14 prevents the photosensitive drum 7 from being exposed to light for a long time, and also from becoming damaged by coming in contact with foreign objects. Referring to FIGS. 1 and 11, the shutter member 14 is also provided with a shutter portion 14*c* for exposing or covering the exposure opening 9*a*, a shutter portion 14*d* for exposing or covering the transfer opening 9*b*, and an arm portion 1*r*3 for connecting the shutter portions 14*c* and 14*d*, in addition to the axis 14*a* and the shutter projection 14*b*, all of which are integrally formed of plastic material.

[Structure for Installing or Removing Process Cartridge]

Next, the structure of the means for removably installing the process cartridge B into the electrophotographic image forming apparatus A will be described.

Figure 5:
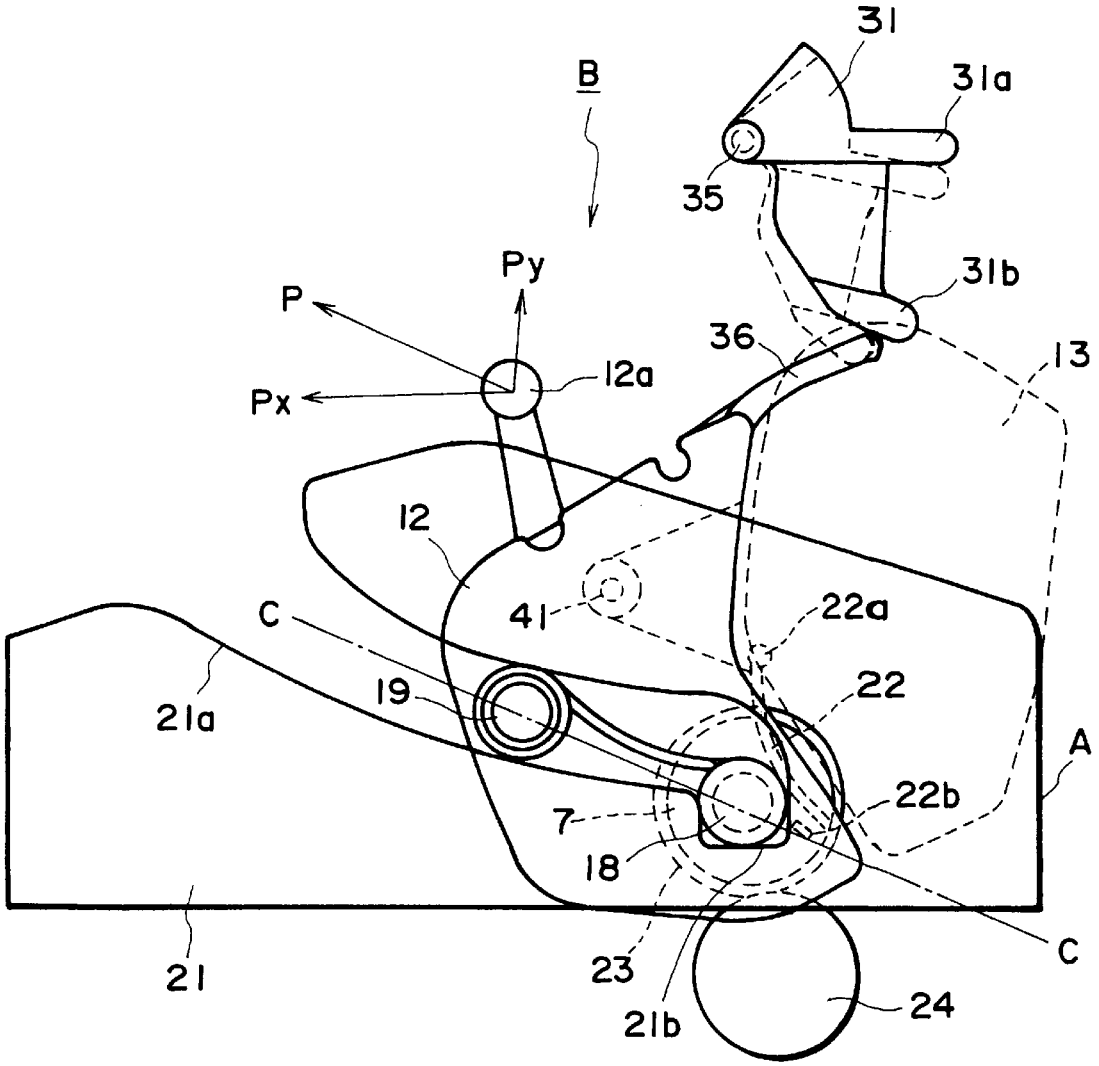
FIG. 5 is also a schematic drawing depicting the structure for positioning the process cartridge in the main assembly of the image forming apparatus, and the relationship between the detectable member, and the apparatus detecting means.

Referring to FIG. 3, the process cartridge B has a cylindrical first projection 18 and a cylindrical second protection 19 (FIG. 3 depicts only one side of the process cartridge B). The first projection 18 is disposed on the surface at the longitudinal end of the cleaning frame 12 (at a point in alignment with the longitudinal axis of the photosensitive drum 7), and serves as positioning means, and the second projection 19 serves to maintain the attitude of the process cartridge B. The first projection 18 is coaxial with the axis of the photosensitive drum 7, and projects outward from the cleaning frame 12. The second projection 19 also projects outward from the cleaning frame 12, and is disposed a predetermined distance away from the first projection 18. More specifically, the second projection 19 is disposed at a location, which is behind the first projection 18 in terms of the direction in which the process cartridge B is inserted into the image forming apparatus A, and is above the first projection 18 when the orientation of the process cartridge B is such that the photosensitive drum 7 comes to the under side. Furthers in this embodiment, a grip handle 12*a* is integrally provided on the top surface of the cleaning frame 12, and when installing or removing the process cartridge B, the operator handles the process cartridge B by gripping the grip handle 12*a* by hand. The grip handle 12*a* is located above a line C—C which connects the centers of the first and second projections 18 and 19 (FIG. 5).

Figure 4:
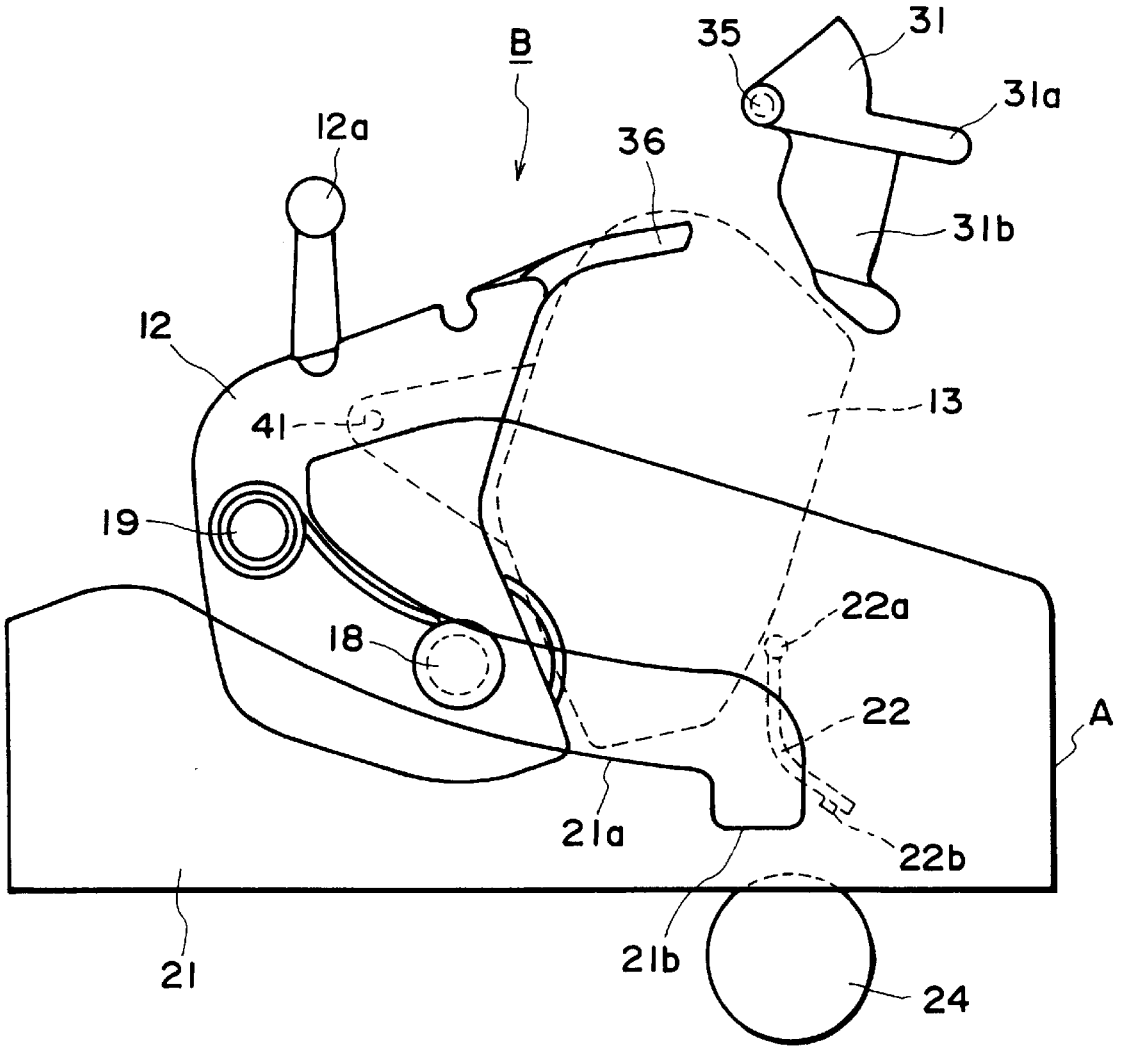
FIG. 4 is a schematic drawing depicting the structure for positioning the process cartridge in the main assembly of the image forming apparatus, and the relationship between the member to be detected (hereinafter, detectable member), and the apparatus detecting means.

On the other hand, as for the image forming apparatus A, the apparatus main assembly 16 is covered with an exterior cover 20. Referring to FIG. 1, the exterior cover 20 has a cover 20*b*, which is pivotably attached to the exterior cover 20 with the use of an axis 20*a*. As the cover 20*b* is opened, the cartridge installation space located within the apparatus main assembly is exposed. On both the left and right walls of the space, a guide member 21 as the cartridge installing means, as illustrated in FIG. 4, is attached. The guide member 21 has a guide groove 21*a*, which extends diagonally downward to guide the first and second projections 18 and 19 of the process cartridge B. At the deepest end of the guide groove 21*a*, a positioning recess 21*b* is provided. This guide member 21, inclusive of the guide groove 21*a* and the positioning recess 21*b*, is integrally formed of plastic material.

Thus, in order to install the process cartridge B into the apparatus main assembly 16, the operator first opens the cover 20*b*. Next, referring to FIG. 4, the process cartridge B is inserted into the apparatus main assembly 16 in a manner to be dropped into the apparatus main assembly 16, the first and second projection 18 and 19 being allowed to follow the guide groove 21*a*. Then, referring to FIG. 5, the process cartridge B is rotated about the second projection 19 in the clockwise direction to drop the first projection 18 into the positioning recess 21*b*, fixing thereby the position of the process cartridge B. While the process cartridge B is in the apparatus main assembly 16, the second projection 19 is in engagement with the guide groove 21*a* thereby maintaining the attitude of the process cartridge B. Also as the process cartridge B is positioned, a drum gear 23 and a driving gear 24, which will be described later, are smoothly meshed.

Also in this embodiment, the guide member 21 is provided with the torsional coil spring 22*a*, which is twisted so as to exert pressure in the clockwise direction about an axis 22*a*, and is rested on a spring rest 22*b*. As the first projection 18 of the process cartridge B drops into the positioning recess 21*b*, the first projection 18 pushes up the spring 22, and in turn, the first projection 18 is pressured diagonally downward into the positioning recess 21*b* by the pressure from the spring 22. As a result, the projection 18 is reliably positioned and fixed in the positioning recess 21*b*. Consequently, the process cartridge B is reliably and stably positioned in the apparatus main assembly 16.

The photosensitive drum 7 is provided with the drum gear 23, a helical gear, which is affixed to one of the longitudinal ends of the photosensitive drum 7 to serve as the portion for receiving the driving force from the apparatus main assembly 16. As the process cartridge B is mounted into the image forming apparatus A as described above, the drum gear 23 meshes with the driving gear 24, a helical gear, which is provided in the apparatus main assembly 16 and is connected to a motor A to transmit the driving force from the motor A. As a result, the driving force from the apparatus main assembly 16 is transmitted to rotate the photosensitive drum 7. The drum gear 23 is meshed with a development roller gear 10*g* (FIG. 21) provided at one of the longitudinal ends of the developing roller 10*c*, and transmits the driving force from the apparatus main assembly 16 to the developing roller 10*c*.

When the process cartridge B is removed from the apparatus main assembly 16, it is impossible to simply pull out the process cartridge B, since the first projection 18 is fitted in the positioning recess 21*b*. Therefore, it is necessary to break the engagement between the first projection 18 and the recess 21*b* before trying to pull out the process cartridge B. In this embodiment, the engagement can be broken in coordination with the pulling of the process cartridge B. Therefore, the drum gear 23 and the driving gear 24 can be smoothly disengaged when the process cartridge B is removed from the apparatus main assembly 16.

In other words, in order to remove the process cartridge B, the operator must pull the grip handle 12*a* toward the operator. Then, the process cartridge B is rotated counter-clockwise about the second projection 19 (FIG. 5), whereby the engagement between the first protection 18 and the recess 21*b* is simply broken. At the same time, the engagement between the drum gear 23 and the driving gear 24 is also smoothly broken. More specifically, referring to FIG. 5, as the grip handle 12*a* is pulled in the direction of an arrow mark P by a force P, the (y) component Py of the force P acts on the first projection 18 as a moment about the second projection 19, whereby the first projection 18 is easily released from the positioning recess 21*b*. Then, the first and second projections 18 and 19 are caused to slide along the guide groove 21*a* by the (x) component Px of the force P, allowing the process cartridge B to be pulled out. In other words, the operator can easily extract the process cartridge B from the main assembly of the image forming apparatus A by pulling the grip handle 12*a* simply in the arrow P direction (direction in which the cartridge is pulled out). Incidentally, the process cartridge B is installed or removed in the direction perpendicular to the axis line of the photosensitive drum 7. As for the orientation of the process cartridge B, the process cartridge B is installed in such a manner that the side with the development means 10 becomes the leading side and the side with the cleaning means becomes the trailing side (installing direction is indicated by an arrow mark x).

Figure 6:
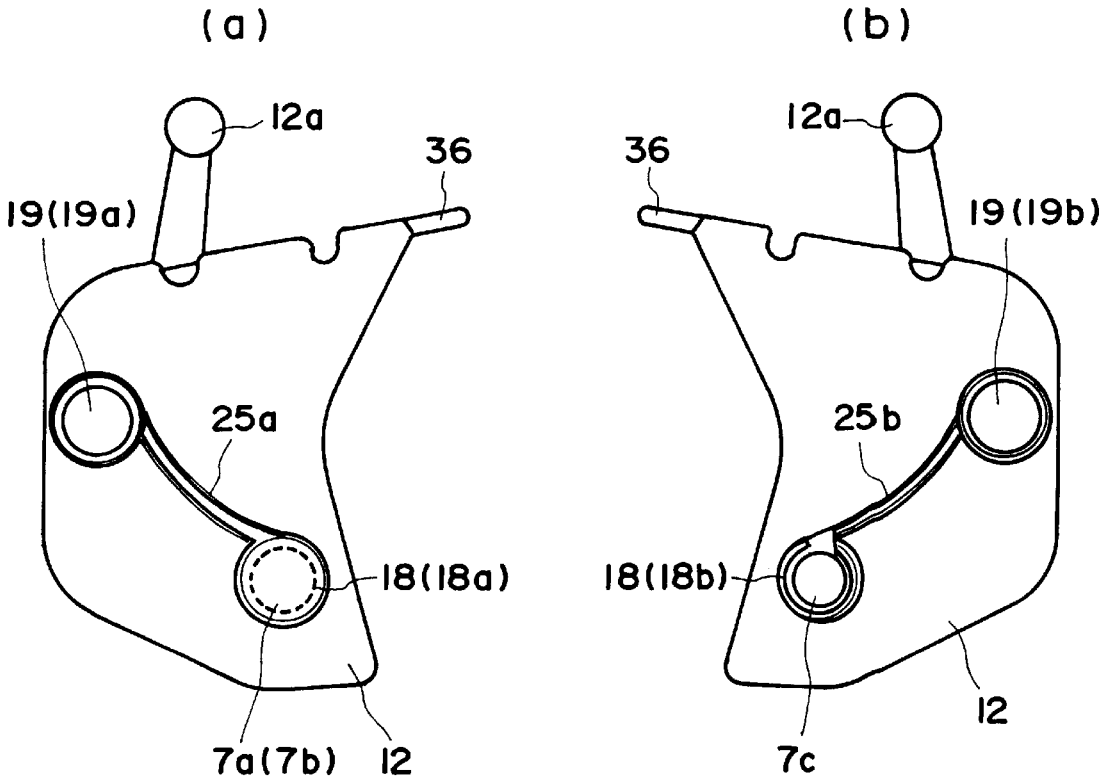
FIG. 6 is a schematic drawing of the positioning projection of a cleaning frame, (a) and (b) being right and left side view, respectively.

At this time, referring to FIG. 6, the first and second projections 19 in this embodiment will be described in more detail. FIGS. 6(*a*) and 6(*b*) depict the right-hand and left-hand sides of the cleaning frame 12, respectively.

As described above, the cylindrical first projection 18 is disposed on each of the surfaces of the longitudinal end of the cleaning frame 12. That is, there is a pair of first projections 18, a right first projection 18*a* and a left first projection 18*b*. The cylindrical second projection is also disposed on each of the surfaces of the longitudinal ends of the cleaning frame 12, that is, there is also a pair of second projections 19, a right second projection 19*a* and a left second projection 19*b*. The relationship among these projections in terms of external diameter is:

Right first projection 18*a*=Left first projection 18*b*<Right second projection 19*a*<Left second projection 19*b*.

Since the relationship among these projections in terms of external diameter is established as described above, when in the image forming apparatus A, the process cartridge B is supported at three points, which improves the positional accuracy of the process cartridge B relative to the apparatus main assembly 16.

More specifically, in this embodiment, the external diameters of the right and left first projections 18*a* and 18*b* are approximately 12.0 mm; the external diameter of the right second projection 19*a* is approximately 12.5 mm; and the external diameter of the left second projection 19*b* is approximately 13.0 mm. The internal diameter of the guide groove 21*a* provided in the apparatus main assembly 16 is approximately 13.0 mm, and the internal diameter of the positioning recess 21*b* is approximately 12.0 mm. Therefore, when the process cartridge B is in the apparatus main assembly 16, the left and right first projections 18*a* and 18*b* are almost exactly fitted in the recess 21*b*. Also, the left second projection 19*b* is almost exactly fitted in the guide groove 21*a*, whereas the right second projection 19*a* is loosely fitted in the guide groove 21*a*. Therefore, the attitude and position of the apparatus main assembly 16 are fixed by three points, that is, the right first projection 18*a*, the left first projection 18*b*, and the left second projection 19*b*. Consequently, even if the process cartridge B is slightly misaligned relative to the axial direction of the photosensitive drum 7, the misalignment can be absorbed. As for the cause of the misalignment, it is possible to think of the distortion such as twisting which occurs during the frame formation. Incidentally, the right second projection 19*a* is disposed on the exterior wall of the. cleaning frame 12, on the non-driven side, that is, the side opposite to where the drum gear 23 is disposed, in terms of the axial direction of the photosensitive drum 7.

Further, a long and narrow right connection wall 25*a* is bridged between the right first projection 18*a* and the right second projection 19*a* in a manner to connect their peripheral surfaces, and also, a long and narrow left connection wall 25*b* is bridged between the left first projection 18*b* and the left second projection 19*b* in a manner to connect their peripheral surfaces. These left and right connection walls 25*a* and 25*b* prevent the cartridge B from rotating by a large angle even if the operator mistakenly lets go of the grip handle 12*a* immediately after the process cartridge B begins to be inserted into the image forming apparatus A or just before the process cartridge B is completely removed. It should be noted here that lack of the left and right connection walls 25*a* and 25*b* does not create any problem when the process cartridge B is installed or removed.

[Structure for Detecting Presence or Absence of Process Cartridge]

As described above, as the process cartridge B is inserted into the image forming apparatus A along the guide groove 21*a*, and the cover 20*b* is closed, the cartridge installation becomes completed. In this embodiment, the image forming apparatus A is structured so that the image forming operation cannot be started unless the apparatus main assembly 16 detects that the process cartridge B is in the apparatus main assembly 16 and the cover 20*b* is closed. "The image forming operation cannot be started" means that even when an image formation start signal is sent to a control section 38 from a host 39, none of the photosensitive drum 7, the processing means such as the developing means 10, the laser unit, and the conveying means can be started to be driven. Next, this structure will be described with reference to FIGS. 7–11.

Figure 7:
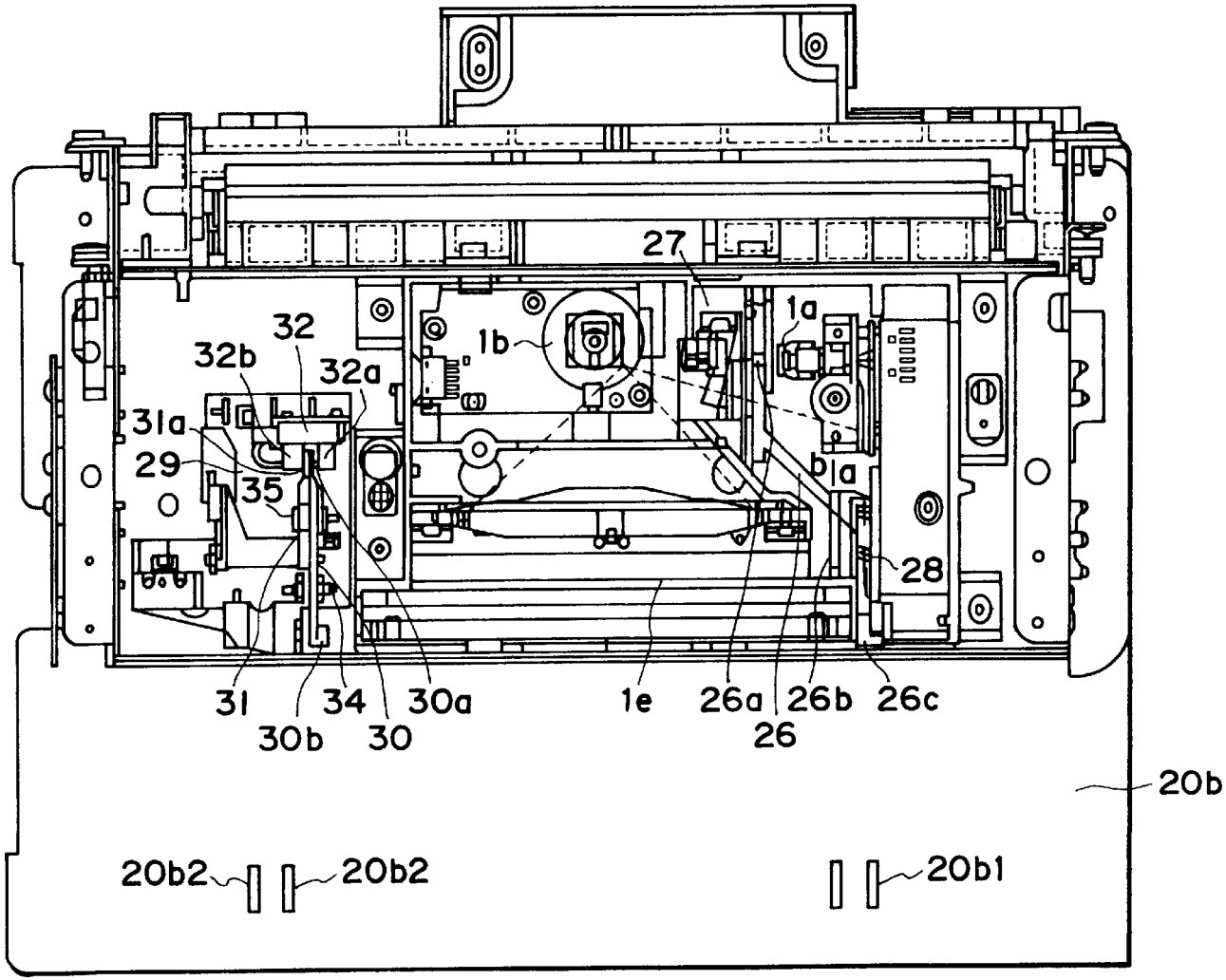
FIG. 7 is a schematic plan view of a laser shutter and a sensor unit.

FIG. 7 is a plan view of a sensing system exposed by opening the cover 20*b*. As is illustrated in the drawing, the aforementioned optical means 1 is disposed at the top. This optical means 1 comprises the laser diode 1*a*, the polygon mirror 1*b*, and a laser shutter 26 disposed between the diode 1*a* and the mirror 1*b*. The laser shutter 26 is mounted so as to allow it to slide along a guide 27 in the directions of arrows a and b in FIG. 7. It is placed under constant pressure generated by a spring 28 in the arrow a direction, remaining in contact with the frame 1*e* by the stopper 26*b*. At one end of the laser shutter 26, a shutter portion 26*a* is erected, and at the other end, a contact portion 26*c* is provided, which comes in contact with a rib 20*b*1, that is, an operational portion erected from the internal surface of the cover 20*b*.

When the cover 20*b* is open, the stopper 26*b* of the laser is in contact with the frame 1*e* as shown in FIG. 7, and the shutter portion 26*a* is between the laser diode 1*a* and the polygon mirror 1*b*, blocking the laser beam from the laser diode 1*a* from reaching the polygon mirror 1*b*. Therefore, when the cover 20*b* is open, the laser beam is blocked by the shutter 26 and is prevented from projecting outward.

On the other hand, as the cover 20*b* is closed, the rib 20*b*1 pushes out the contact portion 26*c* in the arrow b direction, whereby the shutter 26 is caused to slide in the arrow b direction. As a result, the shutter portion 26*a* is moved out of the area between the laser diode 1*a* and the polygon mirror 1*b*. Consequently, the laser beam projected from the laser diode 1*a* is allowed to reach the photosensitive drum 7 by way of the polygon mirror 1*b*. In other words, as the cover 20*b* is opened, the laser beam is blocked, and as the cover 30*b* is closed, the laser beam can be projected onto the photosensitive drum 7.

Also at the top of the apparatus main assembly 16, a sensor unit 26 is disposed next to the frame 1*e* of the optical unit. The sensor unit 26 comprises a cover state detection member 30 which is displaced by the opening or closing movement of the cover 20*b*, a process cartridge detection member 31 which is displaced by the installation or removal of the process cartridge B, and a photointerrupter 32 as means for detecting these members 30 and 31.

Figure 8:
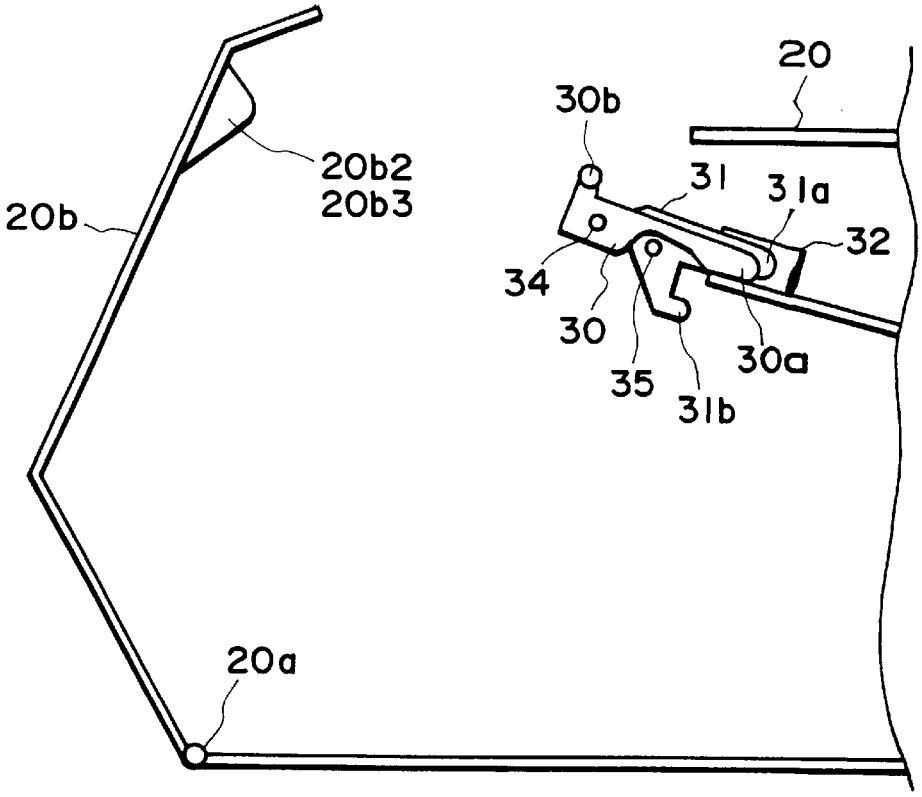
FIG. 8 is a schematic drawing depicting the structure for detecting whether or not the cover is closed without the presence of the process cartridge in the apparatus main assembly, as well as whether or not the process cartridge is in the apparatus main assembly, wherein the structure is depicted with the cover open.

Referring to FIGS. 7 and 8, the cover state detection member 30 is a place-like member rotatable about an axis 34, and the free end 30*a* of the detection member 30 is between the light emitting element 32*a* of the photointerrupter 32, and the photoreceptor element 32*b* of the photointerrupter 32. The fixed end 30*b* of the detection member 30 comes in contact with the rib 20*b*2, that is, the operational portion erected from the internal surface of the cover 20*b*. Therefore, when the cover 20*b* is open, the free end 30*a* remains at a point where it interrupts the light of the photointerrupter 32, keeping the photointerrupter turned off as shown in FIG. 8. On the other hand, as the cover 20*b* is closed, the rib 20*b* comes in contact with the rotatively fixed end 30*b*, and pushes down the rotatively fixed end 30*b* along the slanted surface of the rib 20*b*. As a result, the free end portion 30*a* is moved upward above the photointerrupter 32, turning on the photointerrupter 32. In other words, as the cover 20*b* is opened, the photointerrupter 32 is turned off, and as the cover 20*b* is closed, the photointerrupter 32 is turned on.

Figure 9:
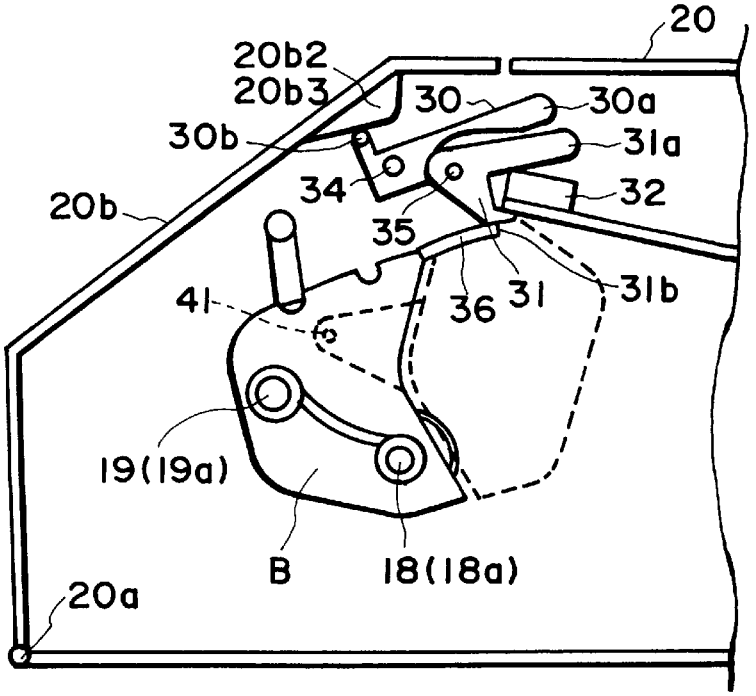
FIG. 9 is a schematic drawing depicting the structure for detecting whether or not the cover is closed without the presence of the process cartridge in the apparatus main assembly, as well as whether or not the process cartridge is in the apparatus main assembly, wherein the structure is depicted with the cover closed.

The cartridge detection member 31 is also a plate-like member like the cover state detection member 30. It is rotatable about an axis 35, and its free end portion 31*a* is between the light emitted element 32*a* and the light receptor element 32*b*. The rotatively affixed portion 31*b* of the cartridge detection member 31 protrudes in the cartridge installation space located below, as shown in FIG. 8. Therefore, when the process cartridge B is not in the space, the self weight of the free end portion 31*a* positions the free end portion 31*a* in a manner to block the light of the photointerrupter 32, and therefore, the photointerrupter 32 remains turned off. On the other hand, as the process cartridge B is inserted, the detectable member of the process cartridge B pushes up the rotatively affixed portion 31*b*; therefore, the free end portion 31*a* is moved above the photointerrupter 32, turning on the photointerrupter 32, as shown in FIG. 9.

Thus, according to this embodiment, as the process cartridge B is installed into the image forming apparatus A, and the cover 20*b* is closed, the photointerrupter 32 is turned on and sends an image formation signal to the control section 38.

At this time, the structure of the detectable member of the process cartridge B, which displaces the cartridge detection member 31, will be described.

Figure 10:
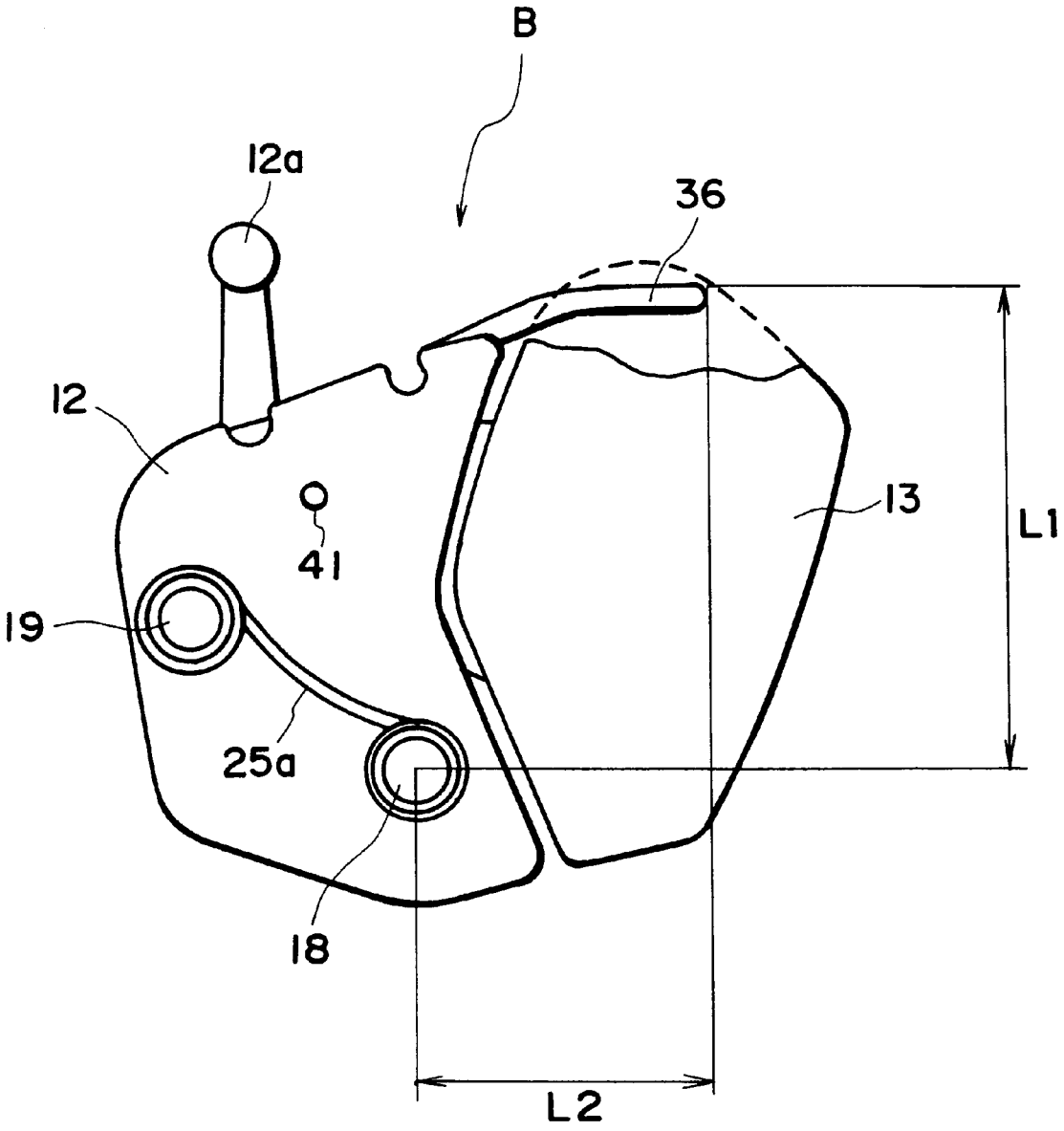
FIG. 10 is a schematic side view of the detectable member provided on the cleaning frame.

Referring to FIGS. 10 and 11, the detectable member 36 is on the top surface of the cleaning frame 12 of the process cartridge B, at a location which is at one of the longitudinal ends of the cleaning frame 12, and at which the detectable member 36 will interfere with the cartridge detection member when the process cartridge B is installed or removed. This longitudinal end of the cleaning frame 12, at which the detectable member 36 is disposed, is the same longitudinal end as the one at which the drum gear 23 is attached to one of the longitudinal ends of the photosensitive drum 7 mounted in the cleaning frame 12 in parallel to the longitudinal direction of the process cartridge B. Further, the top surface of the cleaning frame 12, on which the detectable member is disposed, is the same surface where the exposure opening 9*a* extends in the longitudinal direction of the process cartridge B.

The detectable member 36 is a long and narrow plate member (extending in the direction perpendicular to the axial line of the photosensitive drum 7), and is integrally formed with the cleaning frame 12. It is extended from the cleaning frame 12 in a manner to form a bridge to the development frame 13. In terms of the direction in which the process cartridge B is inserted, the detectable member 36 is at the leading end of the cleaning frame 12, and extends in the same direction. Further, a recess 37 is provided on the top surface of the connecting member 13*c* (member for connecting the cleaning frame 12 and the development frame 13) located on the side where the detectable member 36 extends to the development frame 13. The recess 37 is located at the portion correspondent to the detectable member 36 so that the projecting portion of the detectable member 36 is accommodated by the recess 37. Therefore, the top surface of the detectable member 36 is substantially at the same level as the top surface of the development frame 13; the detectable member 36 does not project above the top surface of the development frame 13.

As described above, when the process cartridge B is in the image forming apparatus A, the detectable member 36 is in contact with the cartridge detection member 31 of the apparatus main assembly 16, pushing up the rotatively affixed portion 31*b* of the cassette detection member 31. Referring to FIG. 4, when the process cartridge B is not in the image forming apparatus A, the detectable member 36 does not act on the cassette detection member 31, and therefore, the rotatively affixed portion 31*a* is positioned to block the light of the photointerrupter 32, due to its own weight, turning off the photointerrupter.

In this embodiment, the process cartridge B is inserted into, or removed from, the electrophotographic image forming apparatus A in the direction perpendicular to the axial line of the photosensitive drum 7. The cleaning frame 12 integrally comprises the detectable member 36, the first projection 18 (18*a*), the second projection 19 (19*a*), and the like.

On the other hand, referring to FIG. 5, as the process cartridge B is inserted into the image forming apparatus A, and the process cartridge B is properly positioned relative to the apparatus main assembly 16, the detectable member 36 pushes up the rotatively affixed portion 31*b* of the cassette detection member 31. As a result, the free end portion 31*a* is moved above the photointerrupter 32, whereby the photointerrupter 32 is turned on. In reality, the detectable member 36 comes in contact with the rotatively affixed portion 31*b* and begins to push up the rotatively affixed portion 31*b* before the first projection 18 (18*a*) drops into the positioning recess 21*b*, that is, before the process cartridge B is properly positioned in the apparatus main assembly 16.

As for the size of the detectable member 36 in this embodiment, referring to FIG. 10, a length L1, which is the height of the top surface of the detectable member 36 of the cleaning frame 12, is approximately 52.0 mm measured from the rotational center of the photosensitive drum 7 (acceptable range: approximately 45.0–60.0 mm). A length L2, which is the length the detectable member 36 projects from the cleaning frame 12 toward the development frame 13, is approximately 39.0 mm measured from the rotational center of the photosensitive drum 7 (acceptable range: approximately 30.0–50.0 mm). Referring to FIG. 11, a length L3, which is the distance from the outward facing surface of the longitudinal end wall of the cleaning frame 12 on the driven side to the inward facing surface of the detectable member 36, in the longitudinal direction of the process cartridge B, is approximately 28.9 mm (acceptable range: approximately 20.0–23.0 mm), and a length L4, which is the width of the detectable member 36 in the longitudinal direction of the process cartridge B, is approximately 13.0 mm (acceptable range: approximately 1.0–30.0 mm).

The photointerrupter 32 is turned on when both the cover state detection member 30 and the cassette detection member 31 have been moved above the photointerrupter 32 (when process cartridge B has been installed and the cover 20 has been closed), and is not turned on when one of the members 30 and 31 has not been moved above the photointerrupter 32 (either when the process cartridge B has not been installed, or when the cover 20*b* has not been closed).

As described above, whether or not the process cartridge B has been installed, or whether or not the cover 20*b* has been closed, is detected using a single sensor, and when the detecting means does not detect the installation of the process cartridge B or the closing of the cover 20*b*, the image forming apparatus A is controlled not to start the image forming operation, by the control section 36 which will be described later.

Also as described above, in this embodiment, the projections 18 and 19 are provided on the cleaning frame 12 of the process cartridge B, and the position of the process cartridge B in the apparatus main assembly 16 is directly fixed by the projections 18 and 19. Further, the detectable member 36 projecting into the development frame 13 side is disposed on the top surface of the cleaning frame 12, on the driven side, and whether or not the process cartridge B has been installed is detected by the function of the detectable member 36; therefore, whether or not the process cartridge B has been installed in the apparatus main assembly 16 can be more accurately detected. As a result, it is possible to reliably prevent the occurrence of such a situation that the image forming operation is started when the process cartridge B is not in the apparatus main assembly 16.

Further, since the detectable member 36 is structured to fit into the recess 37 of the development frame 13, the process cartridge B does not become unnecessarily large; the process cartridge B, as well as the image forming apparatus in which the process cartridge B is installed, can be reduced in size.

[Structure for Connecting Cleaning Frame and Development Frame]

Figure 12:
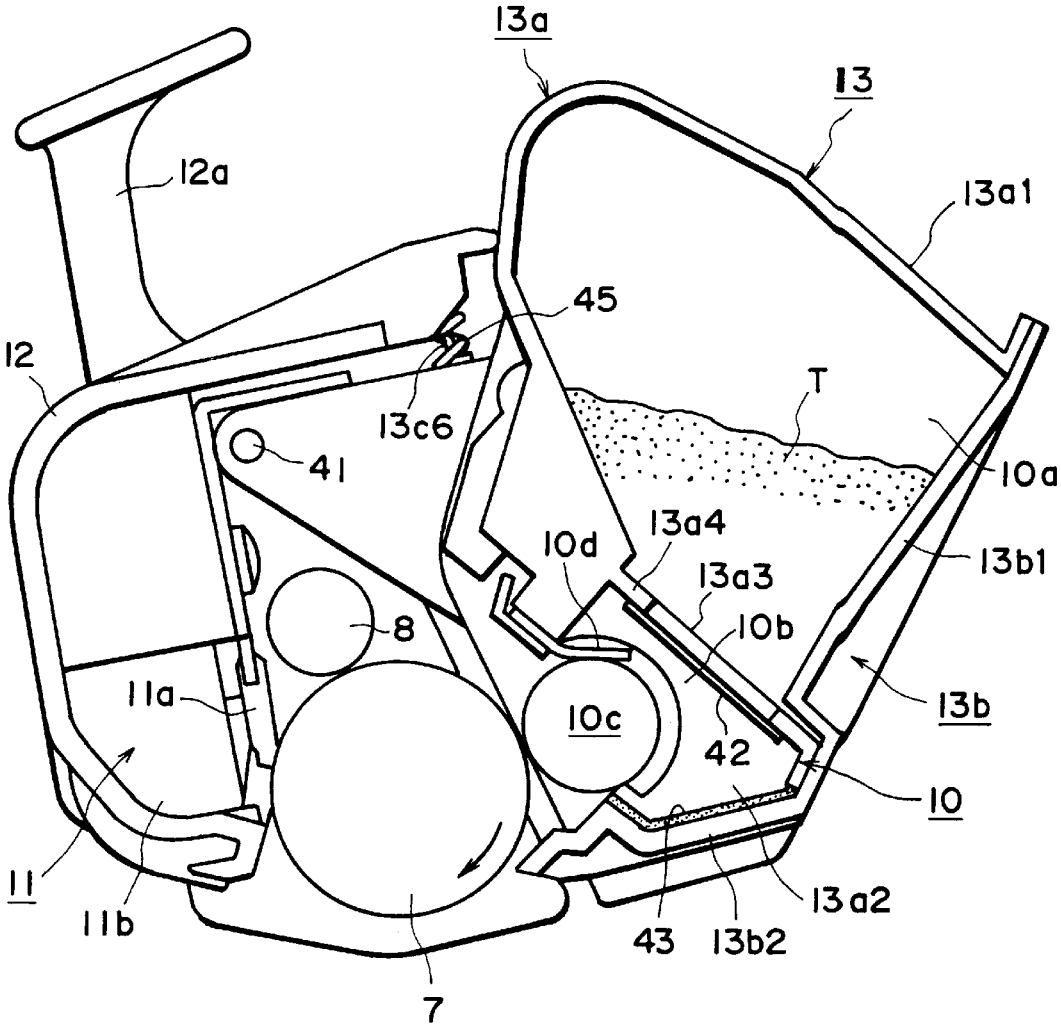
FIG. 12 is a sectional view of the structure of the development frame.
Figure 13:
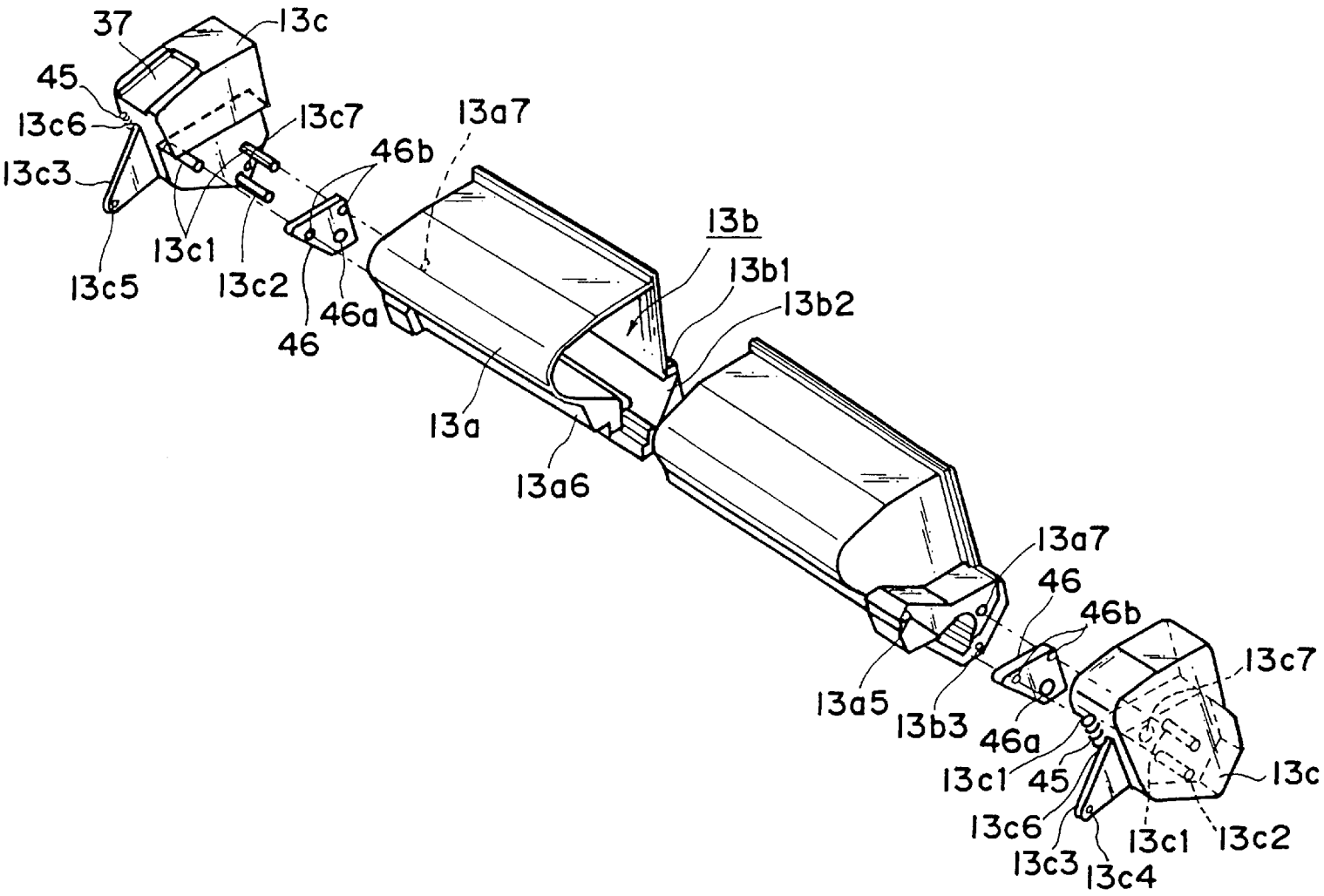
FIG. 13 is an exploded perspective view of the development frame in the embodiment of the present invention.
Figure 14:
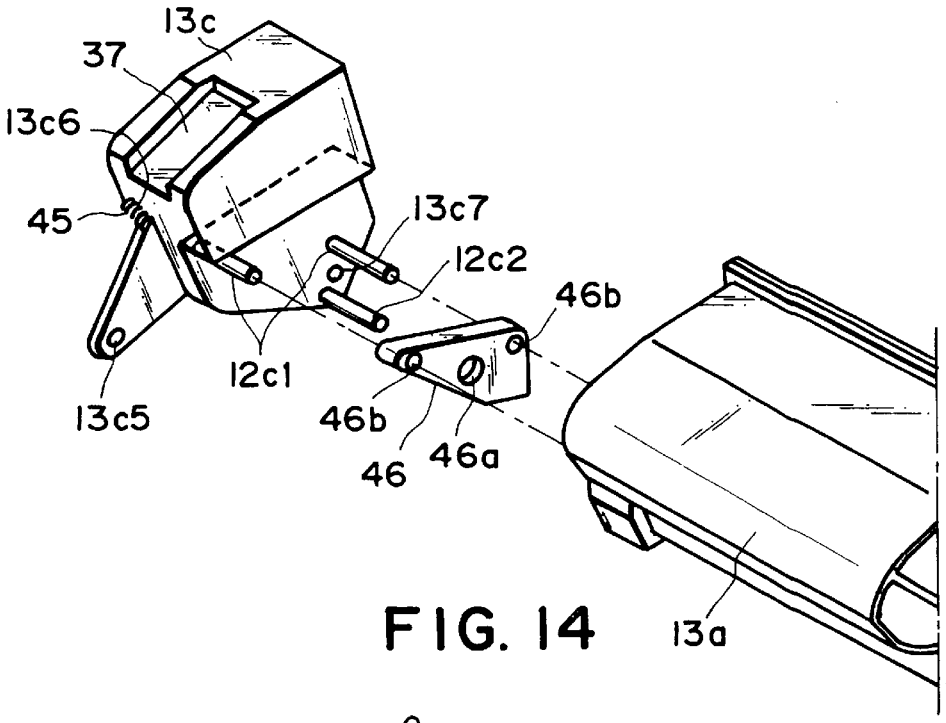
FIG. 14 is an enlarged perspective view of the connecting member.
Figure 15:
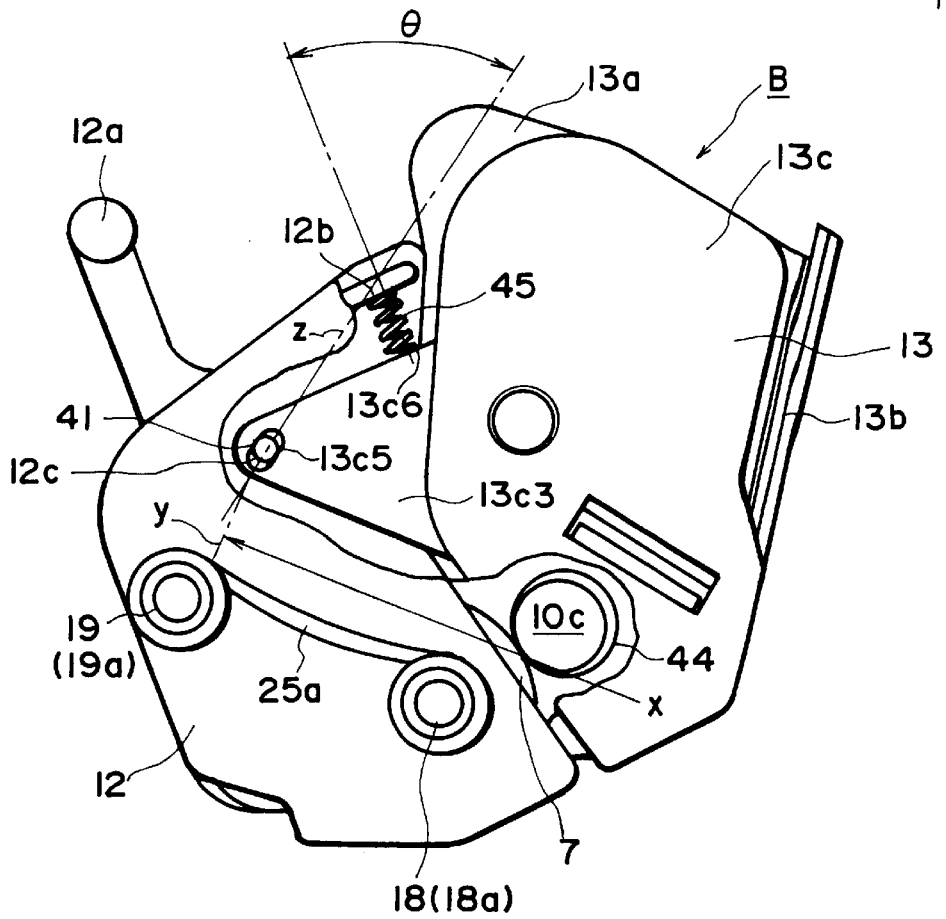
FIG. 15 is a schematic drawing depicting the structure for keeping the cleaning frame and the development frame pressured toward each other.

Next, referring to FIGS. 12–15, the structure of the development frame 13, and the structure for keeping the developing roller 10*c* and the photosensitive drum 7 pressured toward each other, will be described. FIG. 12 is a schematic drawing of the frame structure. FIG. 13 is, an exploded perspective view of the development frame 13. FIG. 14 is an enlarged perspective view of the connecting member. FIG. 15 is a partially cutaway side view of the process cartridge B.

The development frame 13 contains the toner chamber 10*a* and the development chamber 10*b*. In this embodiment, the development frame 13 comprises a development frame main assembly 13*a*, a wall member 13*b*, and a connecting member 13*c*.

Referring to FIGS. 12, 13 and 14, the toner chamber portion 13*a*1 and the development chamber portion 13*a*2 of the frame main assembly 13*a* have at least one opening which stretches in the longitudinal direction of the process cartridge B. Between the toner chamber portion 13*a*1 and development chamber portion 13*a*2, there is a toner supply opening 13*a*3, and a seal attachment surface 13*a*4 on which a toner seal 42 for sealing the opening 13*a*3 is attached. In a fresh cartridge, the seal 42 is removably adhered to the seal attachment surface 13*a*4 to seal the toner T filled in the toner chamber 10*a*.

On the other hand, the wall member 13*b* integrally comprises a toner chamber wall portion 13*b*1 and a development chamber wall portion 13*b*2. The toner chamber wall portion 13*b*1 and the development chamber wall portion 13*b*2 are shaped to completely cover the openings of the toner chamber portion 13*a*1 and the development chamber portion 13*a*2, respectively, of the development frame main assembly 13*a*. The toner chamber wall portion 13*b*1 of the wall member 13*b* is bent into the toner chamber portion 13*a*1 of the development frame main assembly 13*a* (is given an inwardly projecting shape), preventing the toner from remaining behind the seal attachment surface 13*a*4.

The development frame main assembly 13*a* and the wall member 13*b* are joined to form the toner chamber 10*a* and development chamber 10*b*. They are joined by welding the joining surfaces of the toner chamber portion 13*a*1 and the toner chamber wall portion 13*b*1 (in this embodiment, ultrasonic wave welding). Further, between the joining surfaces of the development chamber portion 13*a*2 and the development chamber wall portion 13*b*2, a seal member 43 formed of foamed urethane or rubber material is pinched to seal the gap. The development frame main assembly 13*a* and the wall member 13*b* do not need to be joined by welding; they may be joined with adhesive, small screws, hooks, or the like.

To the development frame main assembly 13*a* and the wall member 13*b* joined as described above, the developing roller 10*c* and the development blade 10*d* are attached, and further, the connecting member or coupling member 13*c* is attached at each longitudinal end of the development frame main assembly 13*a*, with the interposition of a bearing member 46, as depicted in FIGS. 13 and 14.

The connecting member 13*c* is employed to connect the cleaning frame 12 having a photosensitive member attachment portion where the photosensitive drum 7 is attached, and the development frame 13 having a development means attachment portion 13*a*6 where the developing roller 10*c* is attached. Therefore, the connecting member 13*c* comprises: means for positioning the developing roller 10*c*; a connecting portion for connecting the cleaning frame 12 and the development frame 13 in a manner to render them pivotable relative to each other (in this embodiment, a connecting arm portion 13*c*3, and connecting holes 13*c*4 and 13*c*5, are included); and a compression spring attachment portion (in this embodiment, a projection 13*c*6) where a compression spring 45 is attached. The compression spring 45 applies an elastic force to the cleaning frame 12 and the development frame 13 in order to maintain a predetermined positional relationship between the peripheral surfaces of the photosensitive drum 7 and the developing roller 10*c* in the connected cleaning frame 12 and development frame 13. Further, the connecting member 13*c* is provided with a screw hole 13*c*7 for anchoring the connecting member 13*c* to the development frame main assembly 13*a*. In other words, the developing roller 10*c* is supported at each end by the bearing hole 46*a* of the bearing member 46, and the bearing member 46 is accurately positioned relative to the development frame main assembly 13*a*, and affixed thereto. Referring to FIG. 13, in order to accurately affix the connecting member 13*c* to the development frame main assembly 13*a*, two bosses 13*c*1, which serve as the members for anchoring the connecting member 13*c*, are erected from predetermined points, and the longitudinal end surfaces of the development frame main assembly 13*a* are provided with positioning holes 13*a*5 in which the boss 13*c*1 can fit. Also, the bearing member 46 is provided with two positioning holes 46*b* through which the boss 13*c*1 is put. The connecting member 13*c* is fixed to the development frame main assembly 13*a* by fitting the boss 13*c*1 in the positioning hole 13*a*5 after putting it through the positioning hole 46*b*. Consequently, the developing roller 10*c* is rotatively affixed to the development frame main assembly 13*a*.

Further, the connecting member 13*c* is provided with a boss 13*c*2 which is fitted in a positioning hole 13*b*3 provided on both the longitudinal end surfaces of the development chamber wall member 13*b*2. The boss 13*c*2 is fitted in the positioning hole 13*b*3 when the connecting member 13*c* is attached to both longitudinal end portions of the development frame main assembly 13*a*. As a result, the development chamber portion 13*a*2 of the development frame main assembly 13*a*, which has not been welded, and the development chamber wall portion 13*b*2 of the wall member 13*b*, are properly positioned relative to each other, and therefore, even when twisting force or the like acts on the joint, no gap will be created at the joint portion, eliminating the possibility of toner leakage from this portion.

Further, the connecting member 13*c* is provided with the connecting arm portion 13*c*3 to be used to connect the connecting member 13*c* to the cleaning frame 12. The connecting arm 13*c*3 is integrally formed with the connecting member 13*c*, and is provided with connecting holes 13*c*4 and 13*c*5, that is, first holes as connecting portions. They are located at the tip portion of the connecting arm portion 13*c*3. The connecting holes 13*c*4 and 13*c*5 are aligned with a connecting hole 12*c* (FIG. 15) which is a second hole provided at a predetermined point of both longitudinal end portions of the cleaning frame 12, and then, the axis 41 constituted of a pin is pressed in through these holes, whereby the cleaning frame 12 and the development frame 13 are connected to be pivotable relative to each other about the axis 41.

The connecting member 13*c* is formed of plastic material, and integrally comprises the bosses 13*c*1 and 13*c*2, the arm portion 13*c*3, the screw hole 13*c*7, and the projection 13*c*6. The compression spring 45 is attached to the projection 13*c*6 by pressing one end of the compression spring 45 into the projection 13*c*6.

Next, referring to FIGS. 12, 13 and 14, a method for attaching the developing roller 10*c* to the attachment portion 13*a*6 of the development frame main assembly 13*a* will be described.

First, the axis of the developing roller 10*c* is fitted into the bearing hole 46*a* of the bearing member 46, and in this condition, the boss 13*c*1 of the connecting member 13*c* is fitted into the boss hole 46*b*. Then, the connecting member 13*c* is fixed to the development frame main assembly 13*a* using a screw coupling member locking portion 47 (FIG. 16,) which is put through the screw hole 13*c*7 of the connecting member 13*c* and a screw hole 13*a*7 of the longitudinal end wall of the development frame main assembly 13*a*. The development blade 10*d* is attached to the development frame main assembly 13*a* before the developing roller 10*c* is attached.

Thus, the developing roller 10*c* can be attached to the correct location of the development roller attachment portion 13*a*6 of the development frame main assembly 13*a*, and also, the connecting member 13*c* can be attached to the correct location of the development frame 13.

Thereafter, a hole 12*c* of the cleaning frame 12 to which the photosensitive drum 7 has been attached, and the holes 13*c*4 and 13*c*5 of the connecting member 13*c*, are aligned, and the axis 41 (in this embodiment, a metallic pin) is pressed in through these holes of development frame main assembly 13*a*. As a result, the cleaning frame 12 and the development frame 13 are connected to be pivotable relative to each other.

In this embodiment, the cleaning frame 12, the development frame main assembly 13*a* of the development frame 13, the wall member 13*b* of the development frame 13, and the connecting member 13*c*, are all formed of plastic material such as polystyrene, ABS resin (copolymer of acrylonitrile, butadiene, and styrene), polycarbonate, polyethylene, or polypropylene. As for the material for the bearing member 46 which rotatively supports the developing roller 10*c*, wear resistant plastic material such as polyoxymethylene (POM) or metallic material is used. The cleaning frame 12 integrally comprises the grip handle portion 12*a*, the first projection 18, the second projection 19, the connecting projection 25, and the detectable member 36. As described above, the connecting member 13*c* is provided with the bosses 13*c*1 and 13*c*2 which are fitted into the correspondent holes of the longitudinal end wall of the development frame main assembly 13*a*, and the correspondent hole of the wall member 13*b*, to accurately position the developing roller 10*c*, and the connecting holes 13*c*4 and 13*c*5 which are used to connect the development frame 13 to the cleaning frame 12; therefore, the connecting member 13*c* can be easily and accurately positioned in parallel with the developing roller 10*c* and the photosensitive drum 7 which are attached to the cleaning frame 12 using the connecting holes 13*c*4 and 13*c*5.

Further, referring to FIG. 15, the pivotally connected cleaning frame 12 and development frame 13 must be pressured toward each other so that a spacer ring 44 fitted around both the longitudinal end portions of the developing roller 10*c* is pressed on the photosensitive drum 7 to hold a predetermined gap between the developing roller 10*c* and photosensitive drum 7. This is accomplished by the provision of the compression spring 45 as the pressuring means, which is attached to the projection portion 13*c*6 as the spring attachment portion provided at the base portion of the connecting arm portion 13*c*3 of the connecting member 13*c*. This spring 45 is compressed by the development frame 13 and the cleaning frame 12 as they are connected, and the compressed spring 45 rotatively pressures the development frame 13 about the axis 41 in the clockwise direction in FIG. 15. The development roller 10*c* is pressed toward the photosensitive drum 7 by this pressure from the spring 45, and is held a predetermined distance equivalent to the thickness of the spacer ring 25, away from the photosensitive drum 7. Also referring to FIG. 15, the cleaning frame 12 is provided with a boss 12*b*, around which the compression spring 45 is fitted to prevent the compression spring 45 from buckling.

As described above, the connecting holes 13*c*4 and 31*c*5 which serve as the rotational centers for the joined cleaning frame 12 and development frame 13, and. the protection 13c6 where the compression spring 45 is attached, are disposed on the same member; therefore, the distance from the rotational center of the development frame 13 to the point to which the pressure is applied by the compression spring 45, can be precisely set up with ease. As a result, the contact pressure between the developing roller 10c and the photosensitive drum 7 can be accurately set up.

The connecting hole (in this embodiment, the connecting hole 13c4) of the connecting arm 13c3 of one of the connecting members 13c) is a round hole, but the connecting hole (in this embodiment, the connecting hole 13c5) of the connecting arm 13c3 of the other connecting member 13c is an elongated round hole, as shown in FIGS. 13–15. Referring to FIG. 15, the longitudinal direction of the elongated hole 13c5 is in parallel with the line z drawn from the center of the elongated hole 13c5 in a manner to be tangential to the imaginary circle y whose center coincides with the contact point x between the photosensitive drum 7 and the spacer ring 44. The projection 13c6 is formed to project in such a direction that the direction of the pressure from the compression spring 45 holds an angle of θ relative to the longitudinal direction of the elongated hole 13c5. As a result, the pressure applied to the development roller 10c by the compression spring 45 is allowed to act in the longitudinal direction of the elongated hole 13c5. As for the angle θ, a range of 5 deg.–85 deg. is preferable. The spring pressure of the compression spring 45 is preferred to be set in a range of 500–3000 g. Incidentally, in this embodiment, the angle θ is set to approximately 60 deg., and the spring pressure is set to approximately 1500 g.

As described above, one of the connecting holes (connecting hole 13c5) is elongated in a predetermined direction to provide a certain degree of play in the predetermined direction, and the compression spring 45 is attached in a manner to direct its pressure at a predetermined angle relative to the direction of the play; therefore, a certain amount of the pressure from the compression spring 45 can be applied in the direction of the play.

Also, the connecting member 13c is provided with the connecting holes, the bosses, and the spring attachment portion; therefore, the developing roller 10c can be easily held in parallel with the photosensitive drum 7, while maintaining the proper contact pressure between them.

[Structure for Establishing Electrical Connection]

Next, referring to FIGS. 16–22, the structure for establishing electrical connection between electrical contact points will be described. In this embodiment, when the process cartridge B is in the apparatus main assembly 16, the charge bias contact point, the development bias contact point, and the ground contact point, of the process cartridge B are correspondingly connected to the charge bias contact point, the development bias contact point, and the ground contact point, of the apparatus main assembly 16. The charge bias contact point of the process cartridge B is an electrical contact point for receiving the charge bias to be applied to the charge roller 8 from the apparatus main assembly 16. The development bias contact point is an electrical contact point for receiving the development bias to be applied to the developing roller 10c from the apparatus main assembly 16, and the ground contact point is an electrical contact point for discharging the electrical charge accumulated on the photosensitive drum 7 to the apparatus main assembly 16.

Also in this embodiment, when the process cartridge B is in the apparatus main assembly 16, there is a region in which the charge bias region in which the charge bias contact point of the process cartridge B makes contact with the charge bias contact point of the apparatus main assembly 16, and the development bias region in which the development bias contact point of the process cartridge B makes contact with the development bias contact point of the apparatus main assembly 16, overlap in the direction perpendicular to the photosensitive drum 7. Therefore, the dimension of the process cartridge B in the longitudinal direction (axial direction of the photosensitive drum 7) is rendered as short as possible.

Figure 17:
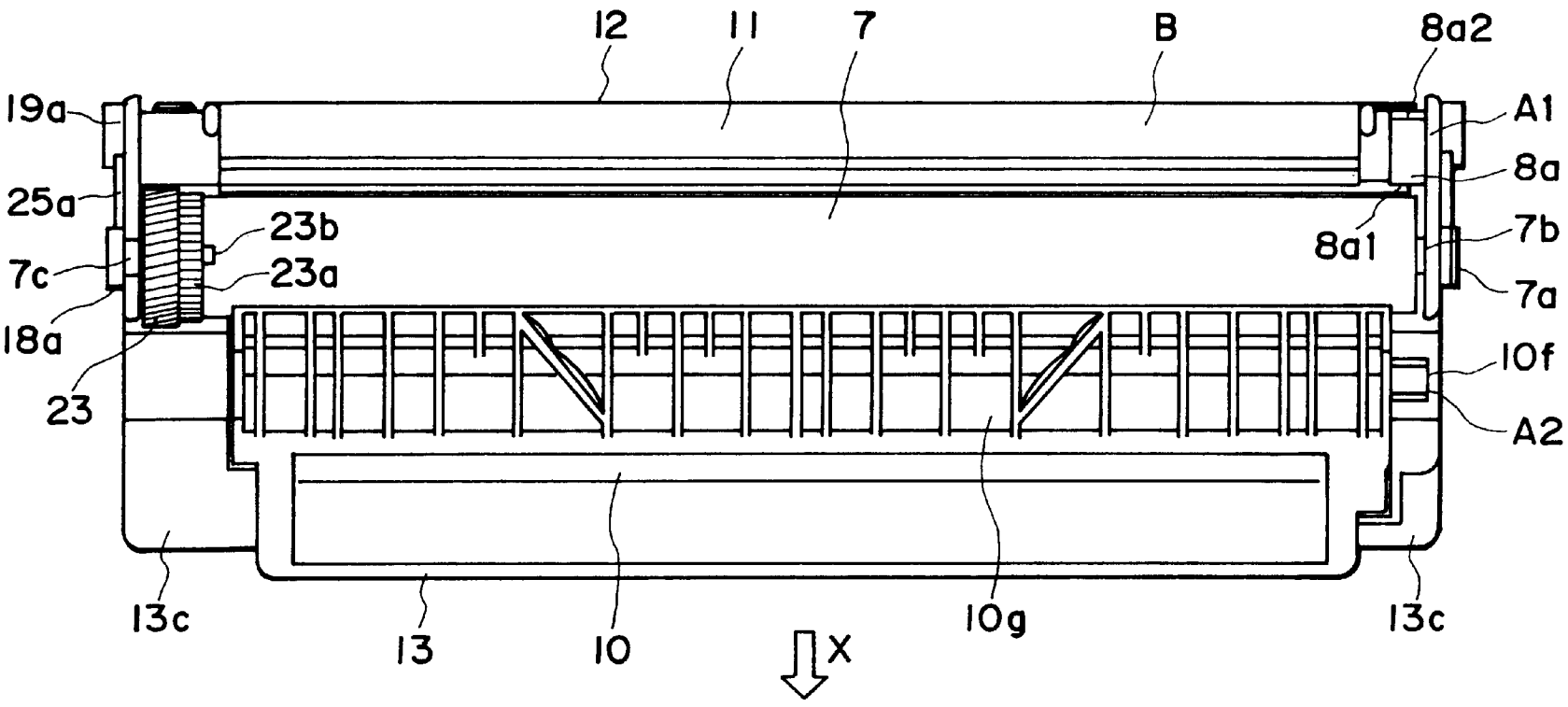
FIG. 17 is a plan view of the process cartridge B as seen from the transfer opening side.
Figure 18:
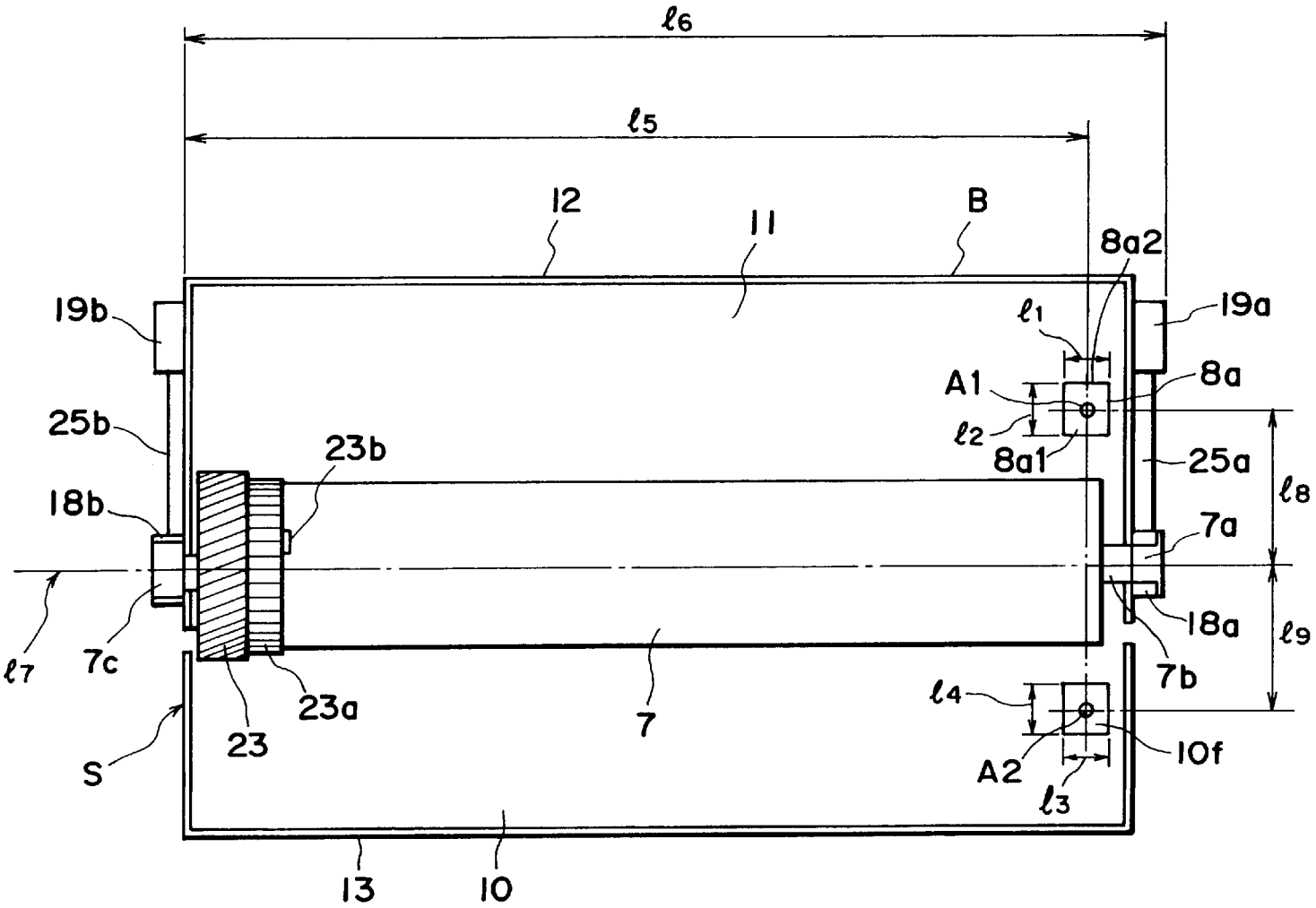
FIG. 18 is a schematic plan view of the process cartridge B.
Figure 19:
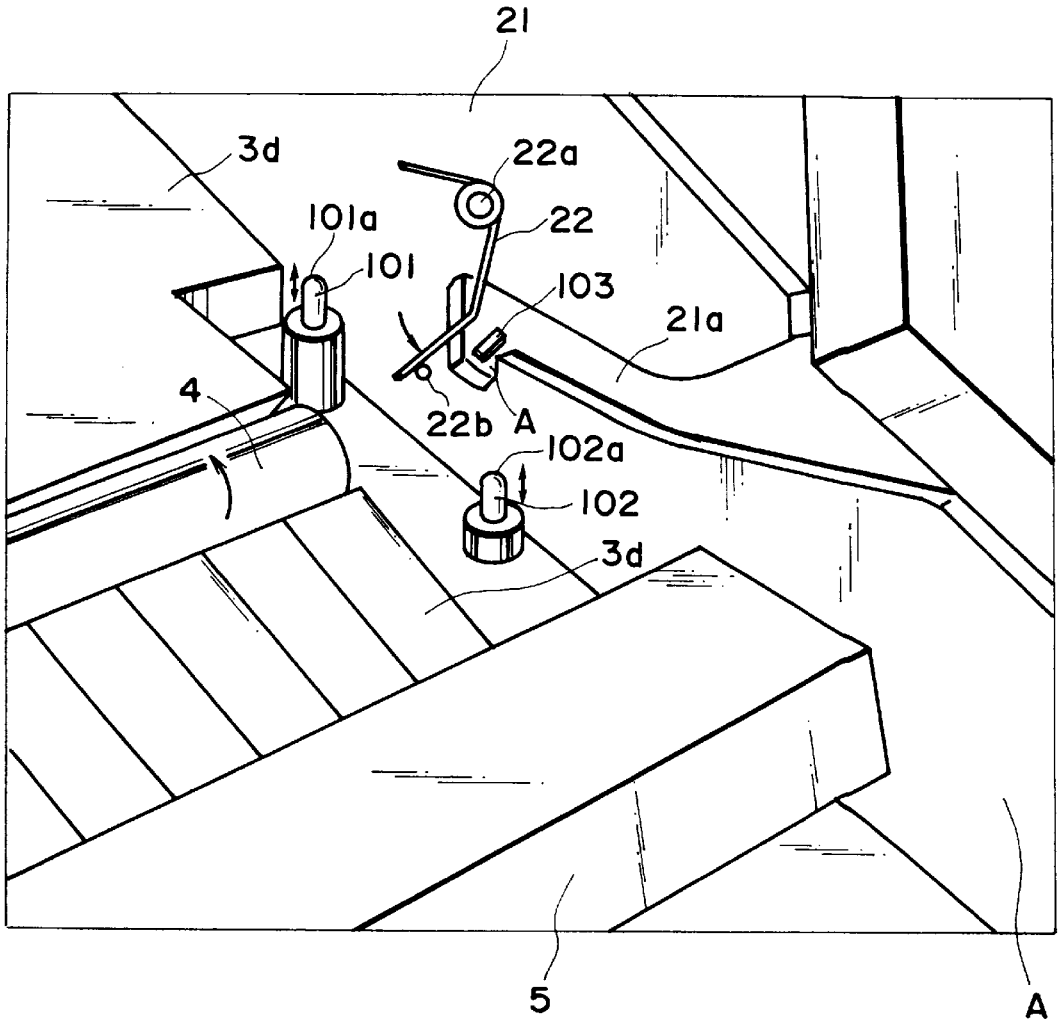
FIG. 19 is an internal perspective view of the main assembly of an apparatus A.

First, the description will be given with reference to FIGS. 16–19. FIG. 16 is a side view of the process cartridge B (side through which the driving force is transmitted). FIG. 17 is a plan view of the process cartridge B as seen from the transfer opening side (plan view as seen from below when the process cartridge B is in the apparatus main assembly 16). FIG. 18 is a schematic plan view of the process cartridge B. FIG. 19 is an internal perspective view of the apparatus main assembly 16.

In this embodiment, the process cartridge B has a charge bias contact point 8a, a development bias contact point 10f, and a ground contact point 7a on. the same side in terms of the axial direction of the photosensitive drum 7. The charge bias contact point 8a and the development bias contact point 10f are aligned in the direction perpendicular to the axial direction of the photosensitive drum 7, across the photosensitive drum 7. In other words, the bias contact points 8a and 10f are disposed across the transfer opening 9b. The charge bias contact point 8a is exposed from the bottom surface of the cleaning frame 12, so that it is positioned at the bottom when the process cartridge B is in the apparatus main assembly 16. However, when the shutter member 14 is closed, the charge bias contact point 8a is behind the shutter member 14; therefore, when the process cartridge B is out of the apparatus main assembly 16, the charge bias contact point 8a is hidden by the shutter member 14, and cannot be seen from outside. The charge bias contact point 8a has a long and narrow configuration, being long in the direction perpendicular to the axial direction of the photosensitive drum 7, and has a flat portion 8a1, and a curved portion which continues from the flat portion 8a1, and gradually curves upward as it extends away from the photosensitive drum 7. Further, the charge bias contact point 8a is disposed in a manner to straddle the end portion of the photosensitive drum 7 in the axial direction of the photosensitive drum 7.

The development bias contact point 10f is rectangular, and is attached to the bottom surface of the development frame 13, being exposed, so that when the process cartridge B is in the apparatus main assembly 16, it is disposed to be on the under side. More specifically, it is attached to the bottom surface of the connecting member 13c, being exposed, and is disposed in a manner to straddle the end portion of the photosensitive drum 7 in the axial direction of the photosensitive drum 7 as the charge bias contact point 8a is. Further, as described before, when the process cartridge B is in the apparatus main assembly 16, there is the region in which the charge bias region A1, in which the charge bias contact point 8a of the process cartridge B makes contact with the development bias contact point 101 of the apparatus main assembly 16, and the development bias region A2, in which the development bias contact point 10f of the process cartridge B makes contact with the development bias contact point 102 of the apparatus main assembly 16, overlap in the direction perpendicular to the axial direction of the photosensitive drum 7. Therefore, according to this embodiment, the length of the process cartridge B in the axial direction of the photosensitive drum 7 can be drastically reduced, and consequently, the size of the process cartridge B can be reduced. Referring to FIGS. 18 and 19, in this embodiment, the region A1 with which the tip of the charge bias contact point pin 101*a* of the apparatus main assembly 16 makes contact, and the region A2 with which the tip of the development bias contact point pin 102*a* of the apparatus main assembly 16 makes contact, overlap in the axial direction of the photosensitive drum 7. Also, the regions A1 and A2 are disposed on the imaginary straight line perpendicular to the axial direction of the photosensitive drum 7. It should be noted here that the two regions do not need to overlap perfectly, that is, the two regions have only to overlap partially. Further, the sizes and configurations of the regions A1 and A2 are regulated by the surface area sizes of the tips of the contact point pins 101*a* and 102*a* of the apparatus main assembly 16, and according to diameters are approximately 0.2–4.0 mm. Also referring to FIG. 18, the centers of the two regions A1 and A2 are disposed on the inward side of the axial ends of the photosensitive drum 7.

Referring to FIG. 19, reference numerals 101 and 102 designate the charge bias contact point and development bias contact point of the apparatus main assembly 16, and make contact with the charge bias contact point 8*a* and development bias contact point 10*f* of the process cartridge B, respectively. The contact point pins 101*a* and 102*a* are under the upward pressure from a spring (unillustrated). As the process cartridge B is inserted into the apparatus main assembly 16, the contact point pins 110*a* and 102*a* are pushed down by the contact points 8*a* and 10*f*, respectively, so that electrical connection can be reliably established and maintained between the contact point pins 101*a* and 102*a* and the contact points 8*a* and 10*f*, respectively. A reference numeral 103 designates a leaf spring as the ground contact point member, which makes contact with the ground contact point 7*a* of the photosensitive drum 7 to ground the photosensitive drum 7. Further, as described above, a reference numeral 22 designates a torsional coil spring, which pressures the first projection 18 (18*a*) onto the positioning recess 21*b* to keep the process cartridge B stable in the apparatus main assembly 16.

When the process cartridge B is in the apparatus main assembly 16, the charge bias contact point 8*a* and the charge bias contact point 101 of the apparatus main assembly 16 are electrically connected to apply a charge bias to the charge roller from the apparatus main assembly 16. The development bias contact point 10*f* is electrically connected to the development bias contact point 102 of the apparatus main assembly 16 to apply a development bias to the developing roller 10*c* from the apparatus main assembly 16. Further, the ground contact point 7*a* is electrically connected to the leaf spring 103 to ground the photosensitive drum 7 to the apparatus main assembly 16. The charge bias and the development bias are applied under the control from the control section 38 which will be described later. Incidentally, in this embodiment, a high voltage bias composed by superposing a DC bias of approximately 625 $V_{DC}$ on an AC bias in the form of a sine wave, having a frequency of approximately 260 Hz and a voltage of approximately 2000 Vpp, is applied from the apparatus main assembly 16 to the charge roller 8. Also to the developing roller 10*c*, a high voltage bias composed by superposing a DC voltage of approximately 425 $V_{DC}$ on an AC bias in the form of a rectangular wave, having a frequency of approximately 1.8 kHz and a voltage of approximately 1200 Vpp, is applied. It should be noted here that the biases do not need to be superposed biases. A DC bias or an AC bias alone may be applied.

Referring to FIG. 17, a reference numeral 10*g* designates a rib provided on the bottom surface of the development frame 13, which guides the recording medium which is being conveyed. A reference numeral 23*a* designates a spur gear, which meshes with a gear (unillustrated) attached to one end of the transfer roller 4 to receive the driving force from the apparatus main assembly 16 and rotates the transfer roller 4. The spur gear 23*a* is integrally formed with the helical gear 23 and is affixed to the photosensitive drum 7 by crimping.

Next, more specific numerical values in this embodiment will be given in FIG. 18. However, these numerical values are not mandatory values, and appropriate values may be optionally selected.

The width l1 of the charge bias contact point 8*a* is approximately 1.0 mm–19.0 mm, preferably approximately 8.0 mm, and the length l2 of the cbcp 81 is approximately 0.5 mm–18.0 mm, preferably approximately 13.0 mm. The width l3 of the development bias contact point 10*f* is approximately 1.0 mm–19.0 mm, preferably approximately 6.0 mm, and the length l4 of the development bias contact point 10*f* is approximately 0.5 mm–15.0 mm, preferably approximately 6.0 mm. The distance l5 between the positioning referential surface S in the longitudinal direction of the process cartridge B (axial direction of the photosensitive drum 7), and the centers of the charge bias contact point 8*a* and the development bias contact point 10*f*, is approximately 259.0 mm–261.0 mm, preferably approximately 260.0 mm. The distance l6 between the above referential surface S, and the tips of the right first projection 18*a* and the right second projection 19*a*, is approximately 270.0 mm–272.0 mm preferably approximately 271.0 mm. The distance l8 between the central axial line l7 of the photosensitive drum 7 and the center of the charge bias contact point 8*a* is approximately 17.2 mm–17.6 mm, preferably approximately 17.4 mm. The distance l9 between the above central axial line l8 and the center of the development bias contact point 10*f* is approximately 27.3 mm–27.7 mm, preferably 27.5 mm.

As for the ground contact point 7*a*, a drum shaft 7*b* projecting outward from the cleaning frame 12 in alignment with the axial line of the photosensitive drum 7 doubles as the ground contact point 7*a*. In other words, the photosensitive drum 7 becomes grounded as the plate spring 103 provided on the apparatus main assembly 16 makes contact with the end surface of the drum shaft 7*b*. In this embodiment, the end surface of the drum shaft 7*b* serves as the ground contact point. This drum shaft 7*b* or a drum shaft 7*c* disposed on the opposite end of the photosensitive drum 7 is accommodated by the correspondent portion of the cleaning frame 12 in the axial direction of the photosensitive drum 7, and in turn, rotatively supports the photosensitive drum 7, on the cleaning frame 12. Both the drum shafts 7*b* and 7*c* are enclosed in the cylindrical portion of the first protection 18 (18*a* and 18*b*), which is coaxial with the photosensitive drum 7, and projects outward from the cleaning frame 12.

Next, referring to FIG. 20, the internal structure of the photosensitive drum 7 will be described. The photosensitive drum 7 in this embodiment is produced by coating a layer 7*e* of photosensitive organic material on the peripheral surface of a cylindrical aluminum drum base 7*d*. This photosensitive drum 7 is rotatively attached to the cleaning frame 12 as shown in the drawing, wherein the helical gear 23 is affixed to one of the longitudinal ends of the photosensitive drum 7. The photosensitive drum 7 is rotated in a predetermined direction in coordination with the image forming operation as the driving force from a driving motor (unillustrated) provided on the apparatus main assembly 16 is transmitted to the helical gear 23 by way of the driving gear 24.

Figure 20:
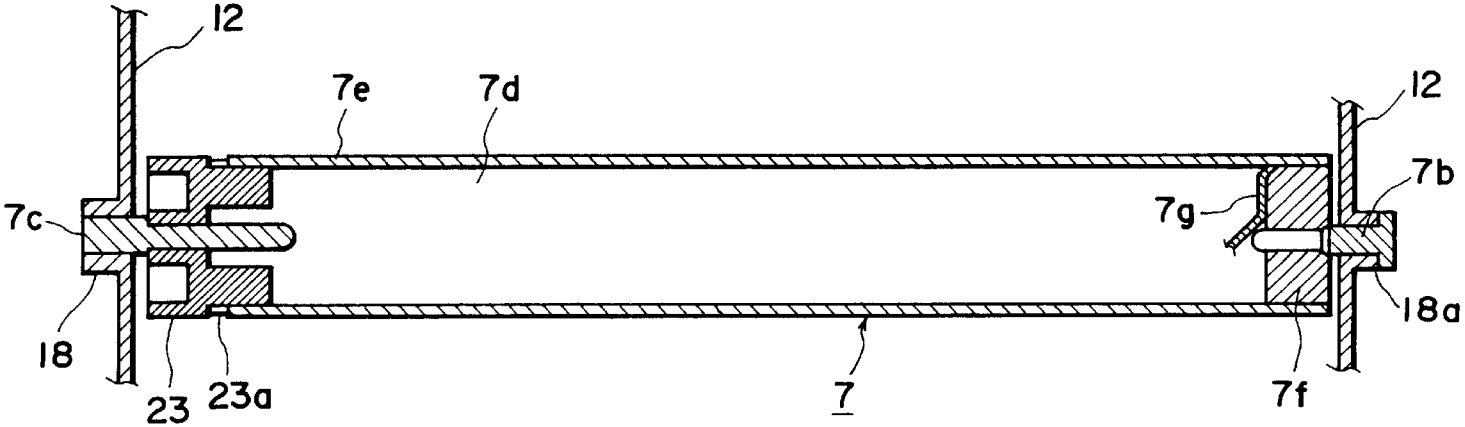
FIG. 20 is a sectional view of the internal structure of a photosensitive drum.

Also referring to FIG. 20, a longitudinal section, a metallic shaft 7*b* is inserted into the hole of a flange 7*f* attached to one of the longitudinal ends of the photosensitive drum 7, and a metallic shaft 7*c* is inserted into the holes of the helical gear 23 and the spur gear 23*a* attached to the other longitudinal end of the photosensitive drum 7 (in this embodiment, both shafts are formed of iron). The shafts 7*b* and 7*c* are affixed, by pressing, in the first projections 18*a* and 18*b*, respectively. Thus, the photosensitive drum 7 is rotatively attached to the cleaning frame 12.

The metallic shaft 7*b* is an electrically conductive member, and is placed in contact with an electrically conductive member 7*g* (in this embodiment, it is formed of phosphor bronze). The electrically conductive member 7*g* is disposed on the internal surface of the photosensitive member, on the side into which the metallic shaft 7*b* is inserted, in a manner to make contact with the internal surface of the aluminum drum base 7*d*, and as the metallic shaft 7*b* is inserted, the tip of the metallic shaft 7*b* comes in contact with the electrically conductive member 7*g*, whereby the photosensitive drum 7 is grounded through the electrically conductive member 7*g* and the metallic shaft 7*b*, to the ground contact point member (plate spring) 103 provided on the apparatus main assembly side.

According to this embodiment, the structure for grounding the photosensitive drum 7 is such that in order to ground the photosensitive drum 7 to the ground contact point member (plate spring) 103 of the apparatus main assembly 16 through the electrically conductive member 7*g* and the metallic shaft 7*b*, the metallic shaft 7*b* is made to project outward from inside the first positioning projection 18*a* of the cleaning frame 12. Therefore, the electrical connection between the tip of the metallic shaft 7*b*, as the ground contact point 7*a*, and the plate spring 103, can be precisely established.

Figure 21:
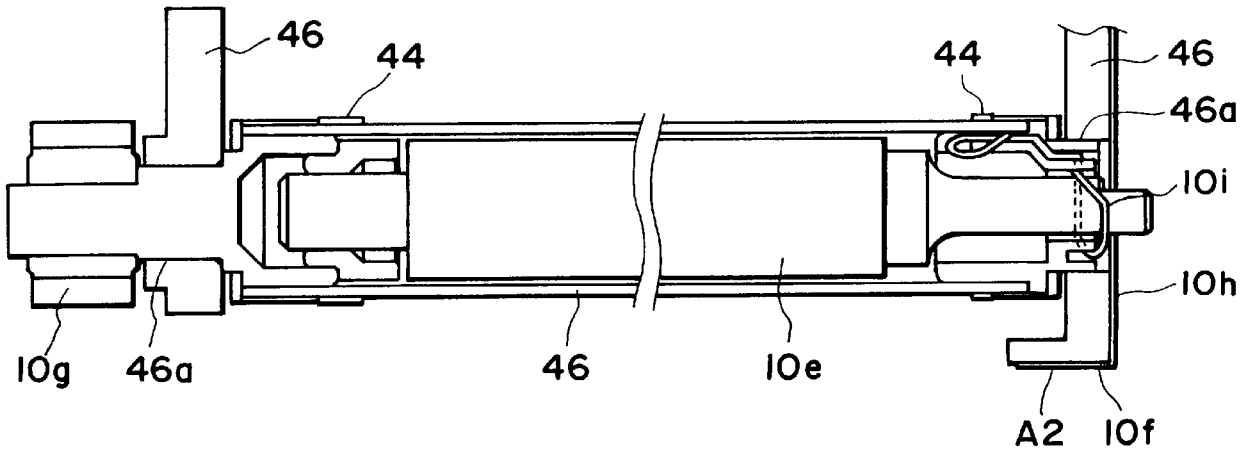
FIG. 21 is a sectional view of a development roller and the adjacencies thereof.

Next, referring to FIG. 21, the path through which the development bias is applied from the development bias contact point 10*f* to the developing roller 10*c* will be described. FIG. 21 is a section of the development roller and the adjacencies thereof.

In this embodiment, a development bias contact point portion (metallic plate) 10*h* comprising the development bias contact point 10*f* is affixed to the outward facing surface of the bearing member 46 disposed on the non-driven side (side on which the gear 10*g* is not affixed, in the axial direction). Further, one end of an electrode wire 10*i* is in contact with the contact point member 10*h*, and the other end is in contact with the internal surface of the developing roller 10*c*. Thus, the development bias, which is received as a part of the contact point 10*f* makes contact with the tip of the contact point pin 102*a* of the development bias contact point 102 of the apparatus main assembly 16 (contact region A1 in FIG. 18), is applied to the developing roller 10*c* by way of the contact point member 10*h* and the electrode wire 10*i*. The contact point member 10*h* is bent approximately 90 degrees, and the bottom surface thereof constitutes the contact point 10*f*.

Figure 22:
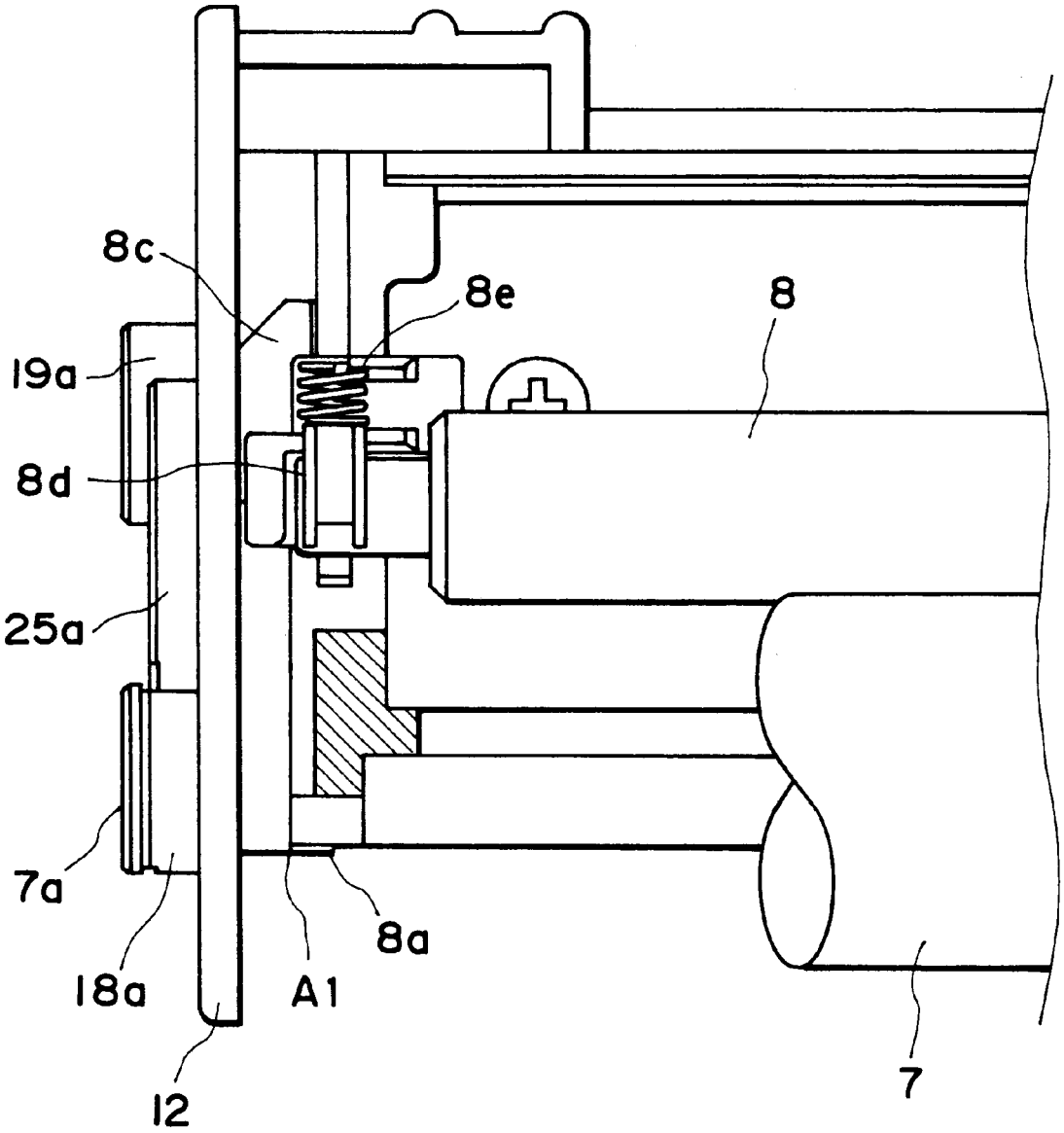
FIG. 22 is a sectional view of a charge roller and the adjacencies thereof.

Next, referring to FIG. 22, the path, through which the charge bias is applied from the charge bias contact point 8*a* to the charge roller 8, will be described. FIG. 22 is a section of the charge roller and the adjacencies thereof.

In this embodiment, the charge bias contact point member (metallic plate) 8*c* comprising the charge bias contact point 8*a* is attached to the non-driven side (side on which the helical gear 23 is not attached, in the axial direction of the photosensitive drum 7) of the cleaning frame 12. Further, a bearing 8*d* formed of electrically conductive resin rotatively supports one end of the charge roller 8. In addition, a coil spring 8*e* for pressuring the bearing 8*d* is provided so that the charge roller 8 is pressured upon the peripheral surface of the photosensitive drum 7 by the elastic force from the coil spring 8*e* (the charge roller 8 is rotated by the rotation of the photosensitive drum 7). Thus, the charge bias, which is received as a part of contact point 8*a* makes contact with the tip of the contact pin 101*a* of the bias contact point 101 of the apparatus main assembly 16, is applied to the charge roller 8 by way of the contact point member 8*c*, the coil spring 8*e*, and the bearing Bd. The contact point member 8*c* is bent approximately 90 degrees, and the bottom surface thereof serves as the contact point 8*a*.

The charge bias contact point member 8*c*, the development bias contact point member 10*h*, the electrode wire 10*i*, and the drum shaft 7*b* are formed of electrically conductive material such as iron or copper (phosphor bronze).

Next, means for controlling the electrophotographic image forming apparatus A in which the above described process cartridge B can be installed will be described.

Figure 23:
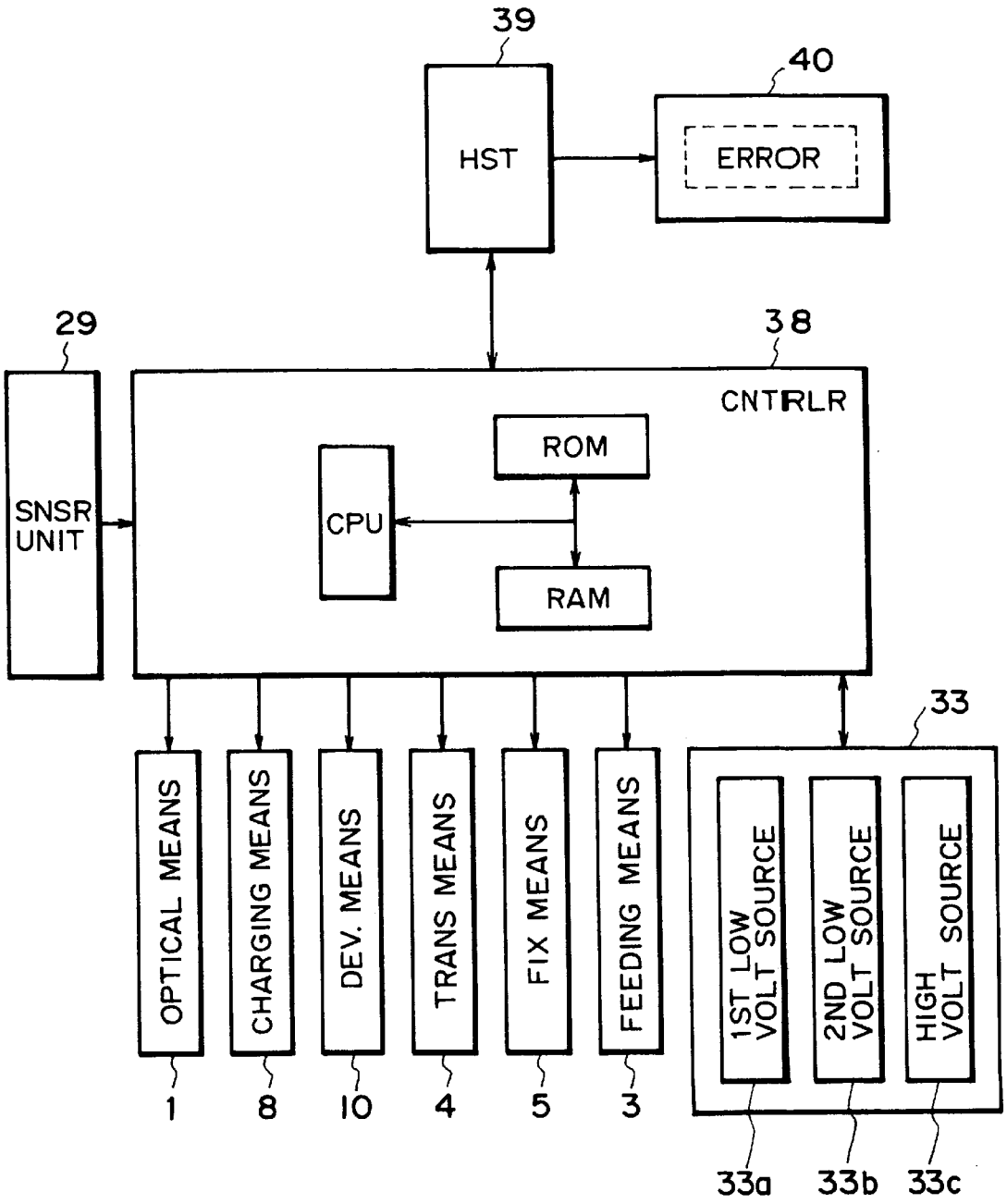
FIG. 23 is a block diagram for apparatus control.

FIG. 23 is a block diagram depicting the structure of the controlling means. In the drawing, a reference numeral 38 designates a control section in charge of the general control of the apparatus. It comprises a CPU such as a microprocessor, ROM's which store control programs for the CPU, and various data, RAM's which temporarily store the various data, and also is used as the work area for the CPU, and the like.

A reference numeral 39 designates a host such as a computer or a word processor, and exchanges electric signals with the control section 38. Further, as described above, when a sensor unit 29 detects that the process cartridge B is not in the apparatus main assembly 16, a detection signal is sent to the control section 38. Then, the control section 38 displays an error message on a pre-designated display 40 through the host 39. Further, when the sensor unit 29 detects that the cover 20*b* is not closed, a signal reflecting the detection is sent to the control section 38. Then, the control-section 38 displays an error message on the display 40 through the host 39 in the same manner as the above. By confirming the error message displayed on the display 40, the operator can find that the process cartridge B is not in the apparatus main assembly 16. When the sensor unit 29 detects that the process cartridge B is not in the apparatus main assembly 16 and/or the cover 20*b* is not closed, the control section 38 turns off a high voltage power source 33*c* of the apparatus power source 33 to abort the image forming operation. The apparatus power source 33 comprises three power sources; a first low voltage power source 33*a* for powering the CPU or the laser, a second low voltage power source 33*b* for driving mainly the motors or the like, and the high voltage power source 33*c* for supplying high voltages necessary for the image formation process to the transfer roller 4, developing roller 10*c*, and the charge roller 8. These power sources 33 (33*a*, 33*b* and 33*c*) supply a voltage with a predetermined value to correspondent components and devices in response to the control signal from the control section 38. The developing roller 10*c* and charge roller 8 are contained in the process cartridge B. Therefore, when the process cartridge B is in the apparatus main assembly 16, the charge bias contact point 8*a* and the development bias contact point 10*f* of the process cartridge B are electrically connected to the charge bias contact point 101 and development bias contact point 102 of the apparatus main assembly 16. Thus, voltages with a correspondent predetermined value are applied from the high voltage power source 33*c* to the developing roller 10*c* and charge roller 8 through the above contact points, respectively.

Further, the control section 38 controls the optical means 1, the charging means 8, the developing means 10, the transferring means 4, the fixing means 5, the conveying means 3, the apparatus power source 33, and the like, in response to the information from the host 39, the sensor unit 29, and the like.

[Miscellaneous Embodiments]

Next, the miscellaneous embodiments of various components and devices in the above described process cartridge B and image forming apparatus in accordance with the present invention will be described.

In the preceding first embodiment, the connecting member 13*c* was attached to the development frame main assembly 13*a* with the use of screws. This is because the process cartridge B can be easily disassembled by simply removing the screws. However, the method for affixing the connecting member 13*c* to the development frame 13 needs not to be the method using screws. For example, a welding method, a gluing method, or a method which holds the connecting member 13*c* and the development frame 13 together by the elasticity of a hook, may be employed.

Also in the first embodiment, in order to apply elastic force to the cleaning frame 12 and the development frame 13, the compression spring 45 was attached to the projection 13*c*6 as the spring attachment portion of the connecting member 13*c*. However, the means for applying the elastic force does not need to be a compression spring. For example, a plate spring or the like can provide the same effects.

Further, the process cartridge B in the first embodiment was of a type which formed a monochromatic image. However, the present invention is preferably applicable not only to a process cartridge which forms a monochromatic image, but also to a process cartridge which comprises multiple developing means and forms a multi-color image (for example, two-color image, three-color image, or full-color image).

Also, the present invention is preferably usable with various known developing methods such as the magnetic brush developing method using two component toner, the cascade developing method, the touch-down developing method, and the cloud developing method.

Also, the electrophotographic photosensitive member is not limited to the photosensitive drum alone. For example, the following may be included. First, as for the photosensitive material, photoconductive material such as amorphous silicon, amorphous selenium, zinc oxide, titanium oxide, or organic photoconductive material may be included. As for the configuration of the base on which the photosensitive material is coated, a rotary configuration such as a drum shape, or a flat configuration such as a belt shape, may be included. Generally, a base in the form of a drum or a belt is employed. For example, in the case of a drum type photosensitive member, photoconductive material is coated on a cylinder of aluminum alloy or the like by painting or vapor deposition.

Further, the charging means may be of a blade type (charge blade), a pad type, a block type, a rod type, or a wire type, in addition to the aforementioned roller type.

The means for cleaning the toner remaining on the photosensitive drum may be of a blade type, a fur brush type, a magnetic brush type, or the like.

The process cartridge in accordance with the present invention is such a process cartridge that is removably installable in the main assembly of an image forming apparatus, and integrally comprises one of the following combinations: an electrophotographic photosensitive member, a charging means, and a developing means or a cleaning means; an electrophotographic photosensitive means, and at least a charging means, a developing means, or a cleaning means; and an electrophotographic photosensitive member, and at least a developing means.

Further, in the preceding embodiments, an electrophotographic image forming apparatus was exemplified by an electrophotographic laser beam printer, but the present invention does not need to be limited to the preceding embodiments. It is obvious that the present invention is also applicable to other electrophotographic image forming apparatuses such as an electrophotographic LED printer, an electrophotographic copying machine, an electrophotographic facsimile apparatus, or an electrophotographic word processor.

According to this embodiment, the coupling member for coupling the first frame and the second frame, is provided with the coupling portion for the frames, the spring mounting portion for urging the frame toward each other and a locking portion for the second frame having the developing means. Therefore, the positioning between the developing means and the electrophotographic photosensitive member is easy, and the parallelism between the photosensitive member and the developing roller can be easily made enough.

The second frame is urged to the first frame. The distance between the coupling portion functioning as a rotational center and the spring mounting portion functioning as an urging position, so that the gap between the developing roller can be set correctly.

Thus, according to the present invention, the assembling can be improved.

While the invention has been described with reference to the structures disclosed herein, it is not confined to the details set forth and this application is intended to cover such modifications or changes as may come within the purposes of the improvements or the scope of the following claims.

What is claimed is:

1. A coupling member for coupling a first frame and a second frame of a process cartridge detachably mountable to a main assembly of an electrophotographic image forming apparatus, said process cartridge including the first frame having an electrophotographic photosensitive member and a photosensitive member mounting portion for mounting said electrophotographic photosensitive member, the second frame having a developing means for developing a latent image formed on said electrophotographic photosensitive member and a developing means mounting portion for mounting said developing means, said coupling member comprising:

a connecting portion for rotatably coupling said first frame and second frame;

a spring mounting portion for mounting a spring for applying elastic force to said first frame and second frame; and a coupling member locking portion for locking said coupling member to said second frame.

2. A coupling member according to claim 1, wherein said connecting portion has a first hole, and wherein a pin penetrates through said first hole and a second hole provided in said first frame to rotatably couple said first frame and second frame.

3. A coupling member according to claim 1, wherein said spring mounting portion is in the form of a projection formed integrally with said coupling member, and wherein a compression spring is mounted to said projection.

4. A coupling member according to claim 1, 2 or 3, wherein said coupling member locking portion is provided with a screw hole for penetration of a screw, and said coupling member is screwed on said second frame by screwing through said screw hole to fasten said coupling member locking portion on said second frame.

5. A coupling member according to claim 3, wherein said electrophotographic photosensitive member is in the form of a drum, and said developing means has a developing roller, wherein a positional relation between said photosensitive drum and said developing roller is maintained by urging said developing roller to a peripheral surface of said photosensitive drum through spacer elements mounted at opposite end portions of said developing roller by an elastic force of said spring.

6. A coupling member according to claim 1, 2, or 3, wherein said coupling member has a boss for positioning said coupling member to said second frame when said coupling member is mounted to said second frame.

7. A process cartridge detachably mountable to a main assembly of an electrophotographic image forming apparatus, comprising:

a. an electrophotographic photosensitive member;

b. a first frame having a photosensitive member mounting portion for mounting said electrophotographic photosensitive member;

c. developing means for developing a latent image formed on said electrophotographic photosensitive member;

d. a second frame having a developing means mounting portion for mounting said developing means;

e. a coupling member including:

a connecting portion for rotatably coupling said first frame and said second frame;

a spring mounting portion for mounting a spring for applying an elastic force to said first frame and second frame to maintain the positional relation between said electrophotographic photosensitive member and said developing means when said first frame and second frame are coupled; and a coupling member locking portion for locking said coupling member to said second frame; and f. a spring mounted to said spring mounting portion of said coupling member;

wherein said first frame and second frame are rotatably coupled by said coupling member.

8. A process cartridge according to claim 7, wherein said connecting portion has a first hole, and wherein a pin penetrates through said first hole and a second hole provided in said first frame to rotatably couple said first frame and second frame.

9. A process cartridge according to claim 7, wherein said spring mounting portion is in the form of a projection formed integrally with said coupling member, and wherein a compression spring is mounted to said projection.

10. A process cartridge according to claim 7, wherein said coupling member locking portion is provided with a screw hole for penetration of a screw, and said coupling member is screwed on said second frame by screwing through said screw hole to fasten said coupling member locking portion on said second frame.

11. A process cartridge according to claim 10, wherein said electrophotographic photosensitive member is in the form of a drum, and said developing means has a developing roller, wherein a positional relation between said photosensitive drum and said developing roller is maintained by urging said developing roller to a peripheral surface of said photosensitive drum through spacer elements mounted at opposite end portions of said developing roller by an elastic force of said spring.

12. A process cartridge according to claim 7, 8, or 9, wherein said coupling member has a boss for positioning said coupling member to said second frame when said coupling member is mounted to said second frame.

13. A process cartridge according to claim 7, further comprising a charging roller for charging said electrophotographic photosensitive member, and a cleaning blade for removing residual developer from said electrophotographic photosensitive member, in said first frame.

14. An electrophotographic image forming apparatus for forming an image on a recording material, to which a process cartridge is detachably mountable, comprising:

a. mounting means for detachably mounting a process cartridge, said process cartridge including:

an electrophotographic photosensitive member;

a first frame having a photosensitive member mounting portion for mounting said electrophotographic photosensitive member;

developing means for developing a latent image formed on said electrophotographic photosensitive member;

a second frame having a developing means mounting portion for mounting said developing means;

a coupling member including a connecting portion for rotatably coupling said first frame and said second frame; a spring mounting portion for mounting a spring for applying an elastic force to said first frame and second frame to maintain the positional relation between said electrophotographic photosensitive member and said developing means when said first frame and second frame are coupled; and a coupling member locking portion for locking the coupling member to said second frame; and a spring mounted to said spring mounting portion of said coupling member; and b. feeding means for transporting said recording material.

15. An assembling method for a process cartridge detachably mountable to a main assembly of an image forming apparatus, comprising:

a. a first step of mounting an electrophotographic photosensitive member to a photosensitive member mounting portion of a first frame;

b. a second step of mounting developing means to a developing means mounting portion of a second frame; and c. a third step of rotatably coupling said first frame and said second frame by a coupling member, which includes:

a connecting portion for rotatably coupling said first frame and second frame;

a spring mounting portion for mounting a spring for applying an elastic force to said first frame and second frame to maintain the positional relation between said electrophotographic photosensitive member and said developing means while said first frame and said second frame are coupled; and a coupling member locking portion for locking said coupling member to said second frame.

16. An assembling method according to claim 15, wherein said third step includes a step of aligning a hole of said first frame with a hole of said connecting portion and causing a pin to penetrate through the holes.

17. A coupling member for coupling a first frame and a second frame of a process cartridge detachably mountable to a main assembly of an electrophotographic image forming apparatus, said process cartridge including the first frame having an electrophotographic photosensitive drum and a photosensitive drum mounting portion for mounting said electrophotographic photosensitive drum, the second frame having a developing roller for developing a latent image formed on said electrophotographic photosensitive drum and a developing roller mounting portion for mounting said developing roller, said coupling member comprising:

a connecting portion for rotatably coupling said first frame and second frame, wherein said connecting portion has a first hole, and wherein a pin penetrates through said first hole and a second hole provided in said first frame to rotatably couple said first frame and second frame, wherein said coupling member has a boss for positioning said coupling member to said second frame when said coupling member is mounted to said second frame;

a spring mounting portion for mounting a spring for applying an elastic force to said first frame and second frame, wherein said spring mounting portion is in the form of a projection formed integrally with said coupling member, and wherein a compression spring is mounted to said projection; and a coupling member locking portion for locking said coupling member to said second frame; wherein said coupling member locking portion is provided with an arm and a screw hole for penetration of a screw provided in said arm, and said coupling member is screwed on said second frame by screwing though said screw hole to fasten said coupling member locking portion on said second frame.

18. A coupling member according to claim 17, wherein a positional relation between said photosensitive drum and said developing roller is maintained by urging said developing roller to a peripheral surface of said photosensitive drum through spacer elements mounted at opposite end portions of said developing roller by an elastic force of said spring.

19. A coupling member according to claim 2 or 17, wherein said pin is press-fitted in said second hole.

20. A process cartridge detachably mountable to a main assembly of an electrophotographic image forming apparatus, comprising:

a. an electrophotographic photosensitive drum;

b. a first frame having a photosensitive drum mounting portion for mounting said electrophotographic photosensitive drum;

c. a developing roller for developing a latent image formed on said electrophotographic photosensitive drum;

d. a second frame having a developing roller mounting portion for mounting said developing roller;

e. a coupling member including:

a connecting portion for rotatably coupling said first frame and said second frame, wherein said connecting portion has a first hole, and wherein a pin penetrates through said first hole and a second hole provided in said first frame to rotatably couple said first frame and second frame, and wherein said coupling member has a boss for positioning said coupling member to said second frame when said coupling member is mounted to said second frame;

a spring mounting portion for mounting a spring for applying an elastic force to said first frame and second frame to maintain the positional relation between said electrophotographic photosensitive drum and said developing roller when said first frame and second frame are coupled; wherein said spring mounting portion is in the form of a projection formed integrally with said coupling member;

a coupling member locking portion for locking said coupling member to said second frame; wherein said coupling member locking portion is provided with a screw hole for penetration of a screw, and said coupling member is screwed on said second frame by screwing through said screw hole to fasten said coupling member locking portion on said second frame; and f. a compression spring mounted to said projection of said coupling member;

wherein said first frame and second frame are rotatably mounted by said coupling member.

21. A process cartridge according to claim 20, wherein said first frame further comprises a charging member for charging said electrophotographic photosensitive drum.

22. A process cartridge according to claim 20 or 21, wherein said first frame further comprises a cleaning member for removing toner remaining on said electrophotographic photosensitive drum.

23. A process cartridge according to claim 8 and 20, wherein said pin is press-fitted in said second hole.

24. An electrophotographic image forming apparatus for forming an image on a recording material, to which a process cartridge is detachably mountable, comprising:

A. mounting means for detachably mounting a process cartridge;

said process cartridge including:

a. an electrophotographic photosensitive drum;

b. a first frame having a photosensitive drum mounting portion for mounting said electrophotographic photosensitive drum;

c. a developing roller for developing a latent image formed on said electrophotographic photosensitive drum;

d. a second frame having a developing roller mounting portion for mounting said developing roller;

e. a coupling member including:

a connecting portion for rotatably coupling said first frame and said second frame, wherein said connecting portion has a first hole, and wherein a pin penetrates through said first hole and a second hole provided in said first frame to rotatably couple said first frame and second frame, and wherein said coupling member has a boss for positioning said coupling member to said second frame when said coupling member is mounted to said second frame;

a spring mounting portion for mounting a spring for applying an elastic force to said first frame and second frame to maintain the positional relation between said electrophotographic photosensitive drum and said developing roller when said first frame and second frame are coupled; wherein said spring mounting portion is in the form of a projection formed integrally with said coupling member;

a coupling member locking portion for locking said coupling member to said second frame; wherein said coupling member locking portion is provided with a screw hole for penetration of a screw, and said coupling member is screwed on said second frame by screwing through said screw hole to fasten said coupling member locking portion on said second frame; and f. a compression spring mounted to said projection of said coupling member; and wherein said first frame and second frame are rotatably coupled by said coupling member;

B. a feeding member for transporting said recording material.

25. An assembling method for a process cartridge detachably mountable to a main assembly of an electrophotographic image forming apparatus, comprising:

a. a first step of mounting an electrophotographic photosensitive drum to a photosensitive drum mounting portion of a first frame;

b. a second step of mounting a developing roller to a developing roller mounting portion of a second frame; and c. a third step of rotatably coupling said first frame and said second frame by a coupling member, which includes:

a connecting portion for rotatably coupling said first frame and second frame;

a spring mounting portion for mounting a spring for applying an elastic force to said first frame and second frame to maintain the positional relation between said electrophotographic photosensitive drum and said developing roller while said first frame and said second frame are coupled; and a coupling member locking portion for locking said coupling member to said second frame;

wherein said third step includes a step of aligning a hole of said first frame with a hole of said connecting portion and causing a pin to penetrate through the holes.

26. An assembling method according to claim 16 or 25, wherein said pin is press-fitted in the hole of said first frame.

27. A coupling member for coupling a first frame and a second frame of a process cartridge detachably mountable to a main assembly of an electrophotographic image forming apparatus, the first frame having an electrophotographic photosensitive drum and a photosensitive drum mounting portion for mounting said electrophotographic photosensitive drum, the second frame having a developing roller for developing a latent image formed on said electrophotographic photosensitive drum a spacer ring fitted on both longitudinal end portions of the developing roller, a developing roller mounting portion for mounting said developing roller said coupling member comprising:

two connecting members, each attached at one longitudinal end of said second frame each connecting member comprising:

a connecting arm portion having a connecting hole at a tip thereof;

a pin for passing through the connecting hole in said connecting arm portion and a hole in said first frame, to form a pivotal connection between said first and second frames;

a projection;

a compression spring attached to the projection, wherein said compression spring and projection are so positioned to apply an elastic force to said first and second frames to bias said first and second frames toward each other;

a screw hole for receiving a screw also passing through said second frame for anchoring said connecting member to said second frame;

first and second anchoring bosses for passing through positioning holes in said second frame and positioning holes in a bearing member; and two bearing members, each interposed between one connecting member and said second frame, each bearing member having a bearing hole therein for supporting an end of said developing roller and two positioning holes for receiving the two anchoring bosses;

wherein said connecting members are fixed to said second frame by fitting said two anchoring bosses through the positioning holes in said bearing member and in said second frame.

28. An assembling method for a process cartridge detachably mountable to a main assembly of an electrophotographic image forming apparatus, comprising:

a first step of fitting the axis of a developing roller of a second frame into a bearing hole of a bearing;

a second step of fitting a boss of a connecting member, connecting a first frame to the second frame, into a boss hole of the bearing and a boss hole of said second frame;

a third step of fixing the connecting member to said second frame using a screw passing through a screw hole of said connecting member and a screw hole of a longitudinal end wall of said second frame;

a fourth step of aligning a hole in said first frame, housing a photosensitive drum, with a hole in said connecting member;

a fifth step of passing a pin through the two aligned holes aligned in said fourth step to create a pivotable connection between the first and second frames;

a sixth step of compressing a compression spring, fitted on a projection of said connecting member, as said first and second frames are connected to each other in said other steps, which biases said second frame around said pin toward said first frame.

29. A process cartridge detachably mountable to a main assembly of an electrophotographic image forming apparatus, comprising:

a. an electrophotographic photosensitive drum;

b. a first frame having a photosensitive drum mounting portion for mounting said electrophotographic photosensitive drum;

c. a developing roller for developing a latent image formed on said electrophotographic photosensitive drum;

d. a second frame having a developing roller mounting portion for mounting said developing roller and a spacer ring fitted on both longitudinal end portions of the developing roller; and e. a coupling member including:

two connecting members, each attached at one longitudinal end of said second frame, each connecting member comprising:

a connecting arm portion having a connecting hole at the tip thereof;

a pin for passing through the connecting hole in said connecting arm portion and a hole in said first frame to form a pivotal connection between said first and second frames;

a projection;

a compression spring attached to the projection, wherein said compression spring and projection are so positioned to apply an elastic force to said first and second frames to bias said first and second frames toward each other;

a screw hole for receiving a screw also passing through said said frame for anchoring said connecting member to said second frame;

first and second anchoring bosses for passing through positioning holes in said second frame and positioning holes in a bearing member; and two bearing members, each interposed between one connecting member and said second frame, each bearing member having a bearing hole therein for supporting an end of said developing roller and two positioning holes for receiving the two anchoring bosses;

wherein said connecting members are fixed to said second frame by fitting said two anchoring bosses through the positioning holes in said bearing member and in said second frame.

* * * * *

UNITED STATES PATENT AND TRADEMARK OFFICE

CERTIFICATE OF CORRECTION

PATENT NO. : 6,070,029
DATED : May 30, 2000
INVENTOR(S) : Tsutomu Nishiuwatoko et al.

It is certified that error appears in the above-identified patent and that said Letters Patent is hereby corrected as shown below:

Title page,
Insert: -- [*] Notice: This patent issued on a continued prosecution application filed under 37 CFR 1.53(d), and is subject to the twenty-year patent term provisions of 35 U.S.C.154(a)(2). --.

Item [56], References Cited, U.S. PATENT DOCUMENTS,
insert: -- 5,537,187 7/1996 Sekine
5,450,166 9/1995 Yashiro --.

Item [56], References Cited, FOREIGN PATENT DOCUMENTS,
insert -- 1-244472 9/1989 Japan --.

Column 3,
Line 33, "cartridge 1." should read -- cartridge. --.
Line 35, "cartridge 1." should read -- cartridge. --.
Line 48, "in" should read -- is --.

Column 4,
Line 26, "manner to" should read -- manner so as to --.

Column 5,
Line 27, "spring•15." should read -- spring 15. --.
Line 43, "protection." should read -- projection --.
Line 61, "Furthers" should read -- Further, --.

Column 6,
Line 4, "pivotably" should read -- pivotally --.
Line 22, "projection" should read -- projections --.

Column 8,
Line 12, "the." should read -- the --.

Column 11,
Line 61, "is," should read -- is --.

UNITED STATES PATENT AND TRADEMARK OFFICE

CERTIFICATE OF CORRECTION

PATENT NO. : 6,070,029
DATED : May 30, 2000
INVENTOR(S) : Tsutomu Nishiuwatoko et al.

It is certified that error appears in the above-identified patent and that said Letters Patent is hereby corrected as shown below:

Column 14,
Line 67, "and. the" should read -- and the --.

Column 15,
Line 10, "13c)" should read -- 13c --.
Line 15, "in" should be deleted.

Column 16,
Line 21, "on." should read -- on --.
Line 49, "under side." should read -- underside. --.

Column 18,
Line 52, "protection" should read -- projection --.

Column 20,
Line 11, "Bd." should read -- 8d. --.
Line 19, "above described" should read -- above-described --.

Column 21,
Line 9, "above described" should read -- above-described --.

Column 22,
Line 24, "easily made" should read -- made easily --.

Column 26,
Line 2, "member," should read -- member; and --.
Line 56, "member," should read -- member; and --.
Line 66, "and" should be deleted.

Column 27,
Line 2, member;" should read -- member; and --.
Line 41, "drum" should read -- drum, --.
Line 44, "roller" should read -- roller, --.
Line 46, "frame" should read -- frame, --.

UNITED STATES PATENT AND TRADEMARK OFFICE

CERTIFICATE OF CORRECTION

PATENT NO. : 6,070,029
DATED : May 30, 2000
INVENTOR(S) : Tsutomu Nishiuwatoko et al.

It is certified that error appears in the above-identified patent and that said Letters Patent is hereby corrected as shown below:

Column 28,
Line 32, "frames;" should read -- frames; and --.

Signed and Sealed this

First Day of January, 2002

*Attest:*

*Attesting Officer*

JAMES E. ROGAN
*Director of the United States Patent and Trademark Office*